US009401230B2

(12) United States Patent
Kuwagaki

(10) Patent No.: US 9,401,230 B2
(45) **Date of Patent: *Jul. 26, 2016**

(54) CU-NI-SI-CO COPPER ALLOY FOR ELECTRONIC MATERIALS AND MANUFACTURING METHOD THEREOF

(75) Inventor: Hiroshi Kuwagaki, Ibaraki (JP)

(73) Assignee: JX Nippon Mining & Metals Corporation, Tokyo (JP)

( * ) Notice: Subject to any disclaimer, the term of this patent is extended or adjusted under 35 U.S.C. 154(b) by 297 days.

This patent is subject to a terminal disclaimer.

(21) Appl. No.: 13/993,648

(22) PCT Filed: Nov. 11, 2011

(86) PCT No.: PCT/JP2011/076082

§ 371 (c)(1),
(2), (4) Date: Jun. 12, 2013

(87) PCT Pub. No.: WO2012/081342

PCT Pub. Date: Jun. 21, 2012

(65) Prior Publication Data

US 2013/0263978 A1 Oct. 10, 2013

(30) Foreign Application Priority Data

Dec. 13, 2010 (JP) ..... 2010-277279

(51) Int. Cl.
*C22F 1/08* (2006.01)
*C22C 9/06* (2006.01)
(Continued)

(52) U.S. Cl.
CPC *H01B 1/026* (2013.01); *C22C 9/06* (2013.01); *C22C 9/10* (2013.01); *C22F 1/00* (2013.01); *C22F 1/06* (2013.01); *C22F 1/08* (2013.01)

(58) Field of Classification Search
CPC ..... C22C 9/06; C22C 9/10
USPC ..... 420/485–488, 490, 496; 148/554
See application file for complete search history.

(56) References Cited

U.S. PATENT DOCUMENTS

2004/0079456 A1* 4/2004 Mandigo et al. ..... 148/554
2007/0062619 A1* 3/2007 Maehara et al. ..... 148/554
(Continued)

FOREIGN PATENT DOCUMENTS

JP 2005532477 A 10/2005
JP 2006283059 A 10/2006
(Continued)

OTHER PUBLICATIONS

Era et al., JP 2009-242890 (machine translation).*
(Continued)

*Primary Examiner* — Keith Walker
*Assistant Examiner* — John Hevey
(74) *Attorney, Agent, or Firm* — Drinker Biddle & Reath LLP

(57) ABSTRACT

Cu—Ni—Si—Co copper alloy strip having excellent balance between strength and electrical conductivity which can prevent the drooping curl is provided. The copper alloy strip for an electronic materials contains 1.0-2.5% by mass of Ni, 0.5-2.5% by mass of Co, 0.3-1.2% by mass of Si, and the remainder comprising Cu and unavoidable impurities, wherein the copper alloy strip satisfies both of the following (a) and (b) as determined by means of X-ray diffraction pole figure measurement based on a rolled surface: (a) among a diffraction peak intensities obtained by β scanning at α=20° in a {200} pole figure, a peak height at β angle 145° is not more than 5.2 times that of standard copper powder; (b) among a diffraction peak intensities obtained by β scanning at α=75° in a {111} pole figure, a peak height at β angle 185° is not less than 3.4 times that of standard copper powder.

11 Claims, 4 Drawing Sheets

(51) Int. Cl.

| | |
|---|---|
| ***C22C 9/10*** | (2006.01) |
| ***C22F 1/00*** | (2006.01) |
| ***H01B 1/02*** | (2006.01) |
| ***C22F 1/06*** | (2006.01) |

(56) References Cited

U.S. PATENT DOCUMENTS

| | | | | |
|---|---|---|---|---|
| 2011/0027122 | A1 | 2/2011 | Era et al. | |
| 2013/0022492 | A1* | 1/2013 | Kuwagaki | 420/473 |
| 2014/0014240 | A1* | 1/2014 | Okafuji et al. | 148/554 |
| 2014/0014241 | A1* | 1/2014 | Kuwagaki et al. | 148/554 |

FOREIGN PATENT DOCUMENTS

| | | | |
|---|---|---|---|
| JP | 2008013836 | A | 1/2008 |
| JP | 2009242890 | A | 10/2009 |
| JP | 2009242921 | A | 10/2009 |
| JP | 2010215976 | A | 9/2010 |
| WO | 2004005560 | A2 | 1/2004 |

OTHER PUBLICATIONS

"International Preliminary Report on Patentability" dated Jun. 18, 2013 for PCT/JP2011/076082, filed Nov. 11, 2011.

* cited by examiner

CU-NI-SI-CO COPPER ALLOY FOR ELECTRONIC MATERIALS AND MANUFACTURING METHOD THEREOF

TECHNICAL FIELD

The present invention relates to a precipitation hardened copper alloy, in particular, the present invention relates to a Cu—Ni—Si—Co copper alloy suitable for use in various electronic components.

BACKGROUND ART

For copper alloys for electronic materials used in various electronic parts such as connectors, switches, relays, pins, terminals, lead frames etc., it is desired to satisfy both high strength and high electrical conductivity (or thermal conductivity) as basic properties. In recent years, high integration as well as reduction in size and thickness of electronic parts have rapidly advanced, and in correspondence, the desired level for copper alloys used in electronic device parts are becoming increasingly sophisticated.

In regards to high strength and high electrical conductivity, the amount of precipitation hardened copper alloy used as the copper alloy for electronic materials, in place of solid solution strengthened copper alloys such as conventional phosphor bronze and brass, have been increasing. In precipitation hardened copper alloys, fine precipitates uniformly disperse by age-treating a solutionized supersaturated solid solution to increase alloy strength, and at the same time the amount of solutionized element in copper decrease to improve electrical conductivity. As a result, a material having mechanical characteristics such as strength and spring property as well as good electrical and thermal conductivity can be obtained.

Among precipitation hardened copper alloys, a Cu—Ni—Si copper alloy generally referred to as the Corson alloy is a representative copper alloy that possesses the combination of relatively high electrical conductivity, strength, and bendability, making it one of the alloys that are currently under active development in the industry. In this copper alloy, improvement of strength and electrical conductivity is attempted by allowing microfine Ni—Si intermetallic compound particles to precipitate in the matrix phase.

Recently, attention is paid to Cu—Ni—Si—Co system alloys produced by adding Co to Cu—Ni—Si system copper alloys, and technology improvement is in progress. Japanese Patent Application Laid-Open No. 2009-242890 (Patent Document 1) describes an invention in which the number density of second phase particles having a particle size of 0.1 μm to 1 μm is controlled to $5\times10^5$ to $1\times10^7/mm^2$, in order to increase the strength, electrical conductivity and spring bending elastic limit of Cu—Ni—Si—Co system alloys.

This document discloses a method for producing a copper alloy, the method including conducting the following steps in order: step 1 of melting and casting an ingot having a desired composition; step 2 of heating the material for one hour or longer at a temperature of from 950° C. to 1050° C., subsequently performing hot rolling, adjusting the temperature at the time of completion of hot rolling to 850° C. or higher, and cooling the material with an average cooling rate from 850° C. to 400° C. at 15° C./s or greater; step 3 of performing cold rolling; step 4 of conducting a solution treatment at a temperature of from 850° C. to 1050° C., cooling the material at an average cooling rate of greater than or equal to 1° C./s and less than 15° C./s until the material temperature falls to 650° C., and cooling the material at an average cooling rate of 15° C./s or greater until the material temperature falls from 650° C. to 400° C.; step 5 of conducting a first aging treatment at a temperature of higher than or equal to 425° C. and lower than 475° C. for 1 to 24 hours; step 6 of performing cold rolling; and step 5 of conducting a second aging treatment at a temperature of higher than or equal to 100° C. and lower than 350° C. for 1 to 48 hours.

Japanese Patent Application National Publication Laid-Open No. 2005-532477 (Patent Document 2) describes that in a production process for a Cu—Ni—Si—Co alloy, various annealing can be carried out as stepwise annealing processes, so that typically, in stepwise annealing, a first process is conducted at a temperature higher than that of a second process, and stepwise annealing may result in a more satisfactory combination of strength and conductivity as compared with annealing at a constant temperature.

JP 2006-283059 A (Patent Document 3) describes a method for manufacturing high strength copper alloy plate for the purpose of producing Corson (Cu—Ni—Si) copper alloy plate having electrical conductivity of 35% IACS or greater, yield strength of 700 $N/mm^2$ or greater and excellent bendability. The method comprises steps of performing hot rolling to an ingot of copper alloy and quenching as necessary; and then performing cold rolling; annealing continuously so as to obtain recrystallized structure and solid solution; and then conducting cold rolling at a reduction ratio of up to 20% and aging treatment at 400-600° C. for 1 hour to 8 hours; and then final cold rolling at a reduction ratio of 1-20%; and then performing annealing at 400-550° C. for up to 30 seconds.

PRIOR ART DOCUMENT

Patent Document 1: Japanese Patent Application Laid-Open No. 2009-242890

Patent Document 2: National Publication No. 2005-532477

Patent Document 1: Japanese Patent Application Laid-Open No. 2006-283059

SUMMARY OF THE INVENTION

Problems to be Solved by the Invention

According to the methods for manufacturing copper alloy described in Patent Documents 1 and 2, strength, electrical conductivity and spring elastic limit of Cu—Ni—Si—Co copper alloy can be enhanced. However, the present inventor has found out the problem of the methods that the strip does not have an adequate accuracy of shape in the case of being manufactured on an industrial scale, and especially drooping curl cannot be controlled enough. The drooping curl is that the material is warped in a rolling direction. When a strip product is manufactured, aging treatment is performed by using a batch-type furnace from the perspective of productive efficiency and production equipment in general. Since the material is subjected to heating treatment with a winded configuration like a coil in the batch-type furnace, the material is curled. As a result, the configuration (the drooping curl) becomes worse. If the drooping curl occurs, terminal for electronic part cannot be formed into stable shape after press working, i.e., accuracy of dimension is reduced. Therefore, it's preferable to prevent the drooping curl as much as possible.

On the other hand, the present inventor has found out that in the case the method for manufacturing copper alloy described in Patent Document 3 is applied to industrial production of Cu—Ni—Si—Co copper alloy strip, the problem of the drooping curl does not occur, but the balance between strength and electrical conductivity is not inadequate.

In view of the above, the subject of the present invention is to provide Cu—Ni—Si—Co copper alloy strip which can achieve a good balance between strength and electrical conductivity and can prevent the drooping curl. In addition, another subject of the present invention is to provide a method for manufacturing such Cu—Ni—Si—Co copper alloy strip.

Means for Solving the Problem

Having made intensive studies so as to solve the above-described problem, the present inventor has found out that a manufacturing method comprises sequential steps of conducting aging treatment and performing cold rolling after conducting a solution treatment in which the aging treatment consists of 3 aging stages under specific conditions of temperature and time, and thereby Cu—Ni—Si—Co copper alloy strip manufactured by the method can achieve a good balance between strength and electrical conductivity and can prevent the drooping curl.

Furthermore, having obtained ratio of diffraction intensity of β of the copper alloy strip produced by the method to that of copper powder at each α by means of X-ray diffraction pole figure measurement based on a rolled surface, the present inventor has found out that Cu—Ni—Si—Co copper alloy strip manufactured by the method has a specific property that the ratio of a peak height at $\alpha=20°$ and $\beta=145°$ in a {200} pole figure to that of standard copper powder is not more than 5.2 times, and the ratio of a peak height at $\alpha=75°$ and $\beta=185°$ in a {111} pole figure to that of standard copper powder is not less than 3.4 times. The reason why such diffraction peaks are obtained is not known exactly but is considered that fine distribution of second phase particles affects the diffraction peaks.

In one aspect, the present invention which was completed based on the above knowledge is a copper alloy strip for an electronic materials containing 1.0-2.5% by mass of Ni, 0.5-2.5% by mass of Co, 0.3-1.2% by mass of Si, and the remainder comprising Cu and unavoidable impurities, wherein the copper alloy strip satisfies both of the following (a) and (b) as determined by means of X-ray diffraction pole figure measurement based on a rolled surface as a base.

(a): Among diffraction peak intensities obtained by β scanning at $\alpha=20°$ in a {200} pole figure, height of a peak at β angle 145° is not more than 5.2 times that of standard copper powder.

(b): Among diffraction peak intensities obtained by β scanning at $\alpha=75°$ in a {111} pole figure, height of a peak at β angle 185° is not less than 3.4 times that of standard copper powder.

In one embodiment of the copper alloy strip according to the present invention, a measurement of drooping curl in a direction parallel to a rolling direction is not more than 35 mm.

In another embodiment of the copper alloy strip according to the present invention, Ni content [Ni] (% by mass), Co content [Co] (% by mass) and 0.2% yield strength YS (MPa) satisfy a relationship expressed by the following formula: $-11\times([Ni]+[Co])^2+146\times([Ni]+[Co])+564\geq YS\geq-21\times([Ni]+[Co])^2+202\times([Ni]+[Co])+436$, Formula (i).

In further embodiment of the copper alloy strip according to the present invention, 0.2% yield strength YS (MPa) satisfies a relationship of $673\leq YS\leq 976$, electrical conductivity EC (% IACS) satisfies a relationship of $42.5\leq EC\leq 57.5$, and the 0.2% yield strength YS (MPa) and the electrical conductivity EC (% IACS) satisfy a relationship expressed by the following formula: $-0.0563\times[YS]+94.1972\leq EC\leq-0.0563\times[YS]+98.7040$, Formula (iii).

In further embodiment of the copper alloy strip according to the present invention, among second phase particles precipitated in a matrix phase, the number density of those particles having a particle size of 0.1 μm to 1 μm is $5\times10^5$ to $1\times10^7/mm^2$.

In further embodiment of the copper alloy strip according to the present invention, the copper alloy strip further contains 0.03-0.5% by mass of Cr.

In further embodiment of the copper alloy strip according to the present invention, Ni content [Ni] (% by mass), Co content [Co] (% by mass) and 0.2% yield strength YS (MPa) satisfy a relationship expressed by the following formula: $-14\times([Ni]+[Co])^2+164\times([Ni]+[Co])+551\geq YS\geq-22\times([Ni]+[Co])^2+204\times([Ni]+[Co])+447$, Formula (ii).

In further embodiment of the copper alloy strip according to the present invention, 0.2% yield strength YS (MPa) satisfies a relationship of $679\leq YS\leq 982$ and electrical conductivity EC (% IACS) satisfies a relationship of $43.5\leq EC\leq 59.5$, and the 0.2% yield strength YS (MPa) and the electrical conductivity EC (% IACS) satisfy a relationship expressed by the following formula: $-0.0610\times[YS]+99.7465\leq EC\leq-0.0610\times[YS]+104.6291$, Formula (iv).

In further embodiment of the copper alloy strip according to the present invention, the copper alloy strip further contains a total of up to 2.0% by mass of one or more selected from the group consisting of Mg, P, As, Sb, Be, B, Mn, Sn, Ti, Zr, Al, Fe, Zn and Ag.

In another aspect, the present invention is a method for manufacturing the copper alloy strip mentioned above, the method comprising the following steps in the described order:

step 1 of melting and casting an ingot having a composition selected from any one of the following (1) to (3), (1) a composition containing 1.0-2.5% by mass of Ni, 0.5-2.5% by mass of Co, 0.3-1.2% by mass of Si, and the remainder comprising Cu and unavoidable impurities;

(2) a composition containing 1.0-2.5% by mass of Ni, 0.5-2.5% by mass of Co, 0.3-1.2% by mass of Si, 0.03-0.5% by mass of Cr and the remainder comprising Cu and unavoidable impurities;

(3) a composition of preceding (1) or (2) further containing a total of up to 2.0% by mass of one or more selected from the group consisting of Mg, P, As, Sb, Be, B, Mn, Sn, Ti, Zr, Al, Fe, Zn and Ag;

step 2 of heating at 950-1050° C. for 1 hour or more, and then performing hot rolling, the temperature at the end of hot rolling being set at 850° C. or more, and then cooling material, the average cooling rate from 850° C. to 400° C. being 15° C./sec or more;

step 3 of performing cold rolling;

step 4 of conducting a solution treatment at 850-1050° C., and then cooling, average cooling rate to 400° C. being 10° C./sec or more;

step 5 of conducting multiple-stage aging treatment in a batch-type furnace with material wound like a coil by heating at a material temperature of 400-500° C. for 1 to 12 hours in first stage, and then heating at a material temperature of 350-450° C. for 1 to 12 hours in second stage, and then heating at a material temperature of 260-340° C. for 4 to 30 hours in third stage, wherein cooling rate from the first stage to the second stage and from the second stage to the third stage is 1-8° C./min, temperature difference between the first stage and the second stage is 20-60° C., and temperature difference between the second stage and the third stage is 20-180° C.; and step 6 of performing cold rolling.

In one embodiment of the method for manufacturing the copper alloy strip according to the present invention, the method further comprises a step of temper annealing by heating at a material temperature of 200-500° C. for 1 second to 1000 seconds after step 6.

In another embodiment of the method for manufacturing the copper alloy strip according to the present invention, the solutionizing step 4 is conducted on condition that average cooling rate to 650° C. is not less than 1° C./sec but less than 15° C./sec, instead of condition that average cooling rate to 400° C. is 15° C./sec or more.

In a further aspect, the present invention is a wrought copper product produced by processing the copper alloy strip according to the present invention.

In a further aspect, the present invention is an electronic component produced by processing the copper alloy strip according to the present invention.

Effect of the Invention

According to the present invention, Cu—Ni—Si—Co copper alloy strip can be obtained which achieves a good balance between strength and electrical conductivity and can prevent the drooping curl.

MODE(S) FOR CARRYING OUT THE INVENTION

Figure 1:
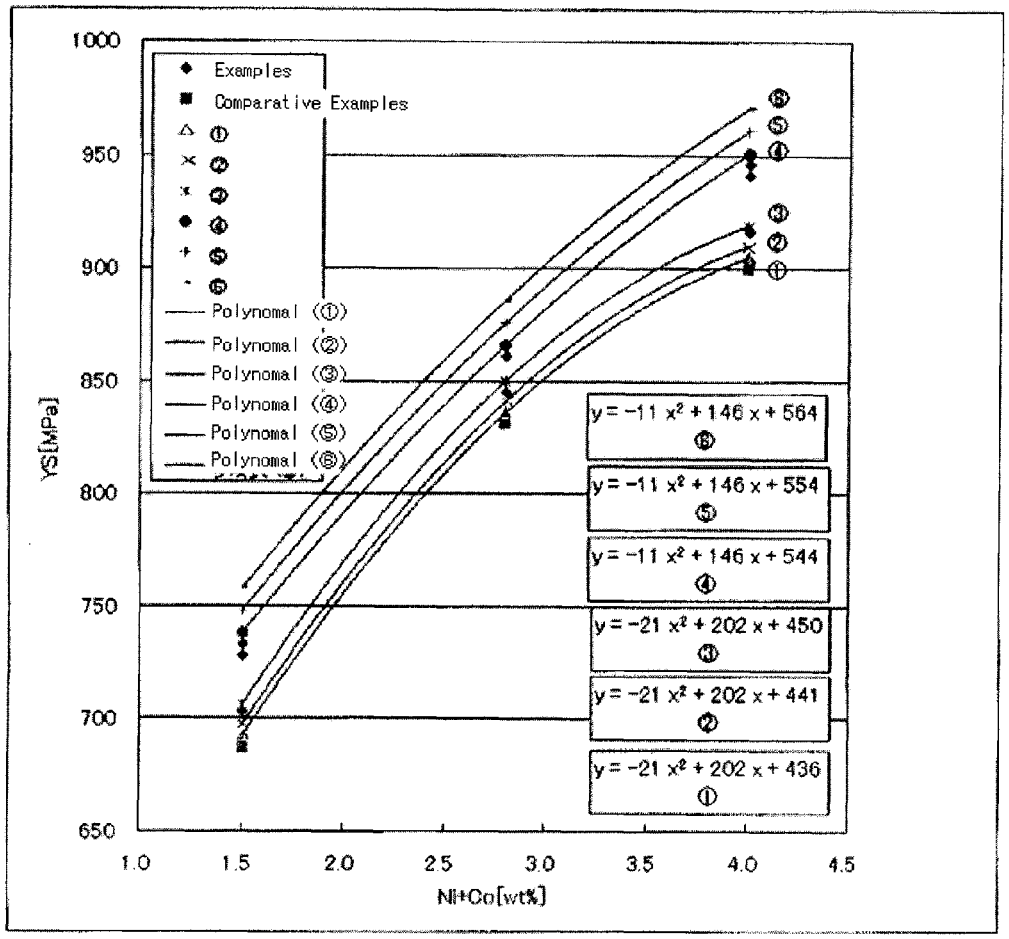
FIG. 1 is a figure regarding Example No. 137-139, No. 143-145, No. 149-151 and Comparative Example No. 174, 178, 182, with total percentage concentration by mass of Ni and Co on the x-axis and YS on the y-axis.

Addition Amounts of Ni, Co and Si

Ni, Co and Si form an intermetallic compound by appropriate thermal treatment, and high strengthening can be attempted without deteriorating electrical conductivity.

Desired strength cannot be obtained if the addition amounts of Ni, Co and Si are Ni: less than 1.0% by mass, Co: less than 0.5% by mass and Si: less than 0.3% by mass, respectively. On the other hand, with Ni: more than 2.5% by mass, Co: more than 2.5% by mass and Si: more than 1.2% by mass, high strengthening can be attempted but electrical conductivity is significantly reduced, and further, hot working capability is deteriorated. The addition amounts of Ni, Co and Si are therefore set at Ni: 1.0-2.5% by mass, Co: 0.5-2.5% by mass and Si: 0.3-1.2% by mass. The addition amounts of Ni, Co and Si are preferably Ni: 1.5-2.0% by mass, Co: 0.5-2.0% by mass and Si: 0.5-1.0% by mass.

If the ratio of total mass concentration of Ni and Co to mass concentration of Si, [Ni+Co]/Si, is too low, i.e., the ratio of Si to Ni and Co is too high, electrical conductivity is reduced because of solid solution Si, or $SiO_2$ oxide film is formed on material surface during annealing process and thereby solderability deteriorates. On the other hand, if the ratio of Ni and Co to Si becomes higher, high strength cannot be achieved due to the lack of Si necessary for silicide formation.

Accordingly, the [Ni+Co]/Si ratio may preferably be controlled within the range of $4 \leq [Ni+Co]/Si \leq 5$, more preferably within the range of $4.2 \leq [Ni+Co]/Si \leq 4.7$.

Addition Amount of Cr

In the cooling process during casting, Cr can strengthen crystal grain boundary because it preferentially precipitates at the grain boundary, allows for less generation of cracks during hot working, and can control the reduction of yield. In other words, Cr that underwent grain boundary precipitation during casting will be resolutionized by for example solutionizing, but forms precipitation particles of bcc structure having Cr as the main component or a compound with Si during the subsequent aging treatment. In an ordinary Cu—Ni—Si alloy, of the amount of Si added, Si that did not contribute to precipitation will control the increase in electrical conductivity while remaining solutionized in the matrix, but the amount of solutionized Si can be decreased by adding silicide-forming element Cr to further precipitate the silicide, and electrical conductivity can be increased without any loss in strength. However, when Cr concentration is more than 0.5% by mass, coarse second phase particles tend to form and product property is lost. Accordingly, up to 0.5% by mass of Cr can be added to the Cu—Ni—Si—Co alloy according to the present invention. However, since less than 0.03% by mass will only have a small effect, preferably 0.03-0.5% by mass, more preferably 0.09-0.3% by mass may be added.

Addition Amounts of Mg, Mn, Ag and P

Mg, Mn, Ag and P will improve product properties such as strength and stress relaxation property without any loss of electrical conductivity with addition of just a trace amount. The effect of addition is mainly exerted by solutionizing into the matrix, but further effect can also be exerted by being contained in second phase particles. However, when the total concentration of Mg, Mn, Ag and P is more than 2.0% by mass, the effect of improving the property will saturate and in addition manufacturability will be lost. Accordingly, a total of up to 2.0% by mass, preferably up to 1.5% by mass of one or two or more selected from Mg, Mn, Ag and P can be added to the Cu—Ni—Si—Co copper alloy according to the present invention. However, since less than 0.01% by mass will only have a small effect, preferably a total of 0.01-1.0% by mass, more preferably a total of 0.04-0.5% by mass is added.

Addition Amounts of Sn and Zn

Sn and Zn will also improve product properties such as strength, stress relaxation property, and platability without any loss of electrical conductivity with addition of just a trace amount. The effect of addition is mainly exerted by solutionizing into the matrix. However, when the total concentration of Sn and Zn is more than 2.0% by mass, the effect of improving the property will saturate and in addition manufacturability will be lost. Accordingly, a total of up to 2.0% by mass of one or two selected from Sn and Zn can be added to the Cu—Ni—Si—Co copper alloy according to the present invention. However, since less than 0.05% by mass will only have a small effect, preferably a total of 0.05-2.0% by mass, more preferably a total of 0.5-1.0% by mass may be added.

Addition Amounts of As, Sb, Be, B, Ti, Zr, Al and Fe

As, Sb, Be, B, Ti, Zr, Al and Fe will also improve product properties such as electrical conductivity, strength, stress relaxation property, and platability by adjusting the addition amount according to the desired product property. The effect of addition is mainly exerted by solutionizing into the matrix, but further effect can also be exerted by being contained in second phase particles, or by forming second phase particles of new composition. However, when the total of these elements is more than 2.0% by mass, the effect of improving the property will saturate and in addition manufacturability will be lost. Accordingly, a total of up to 2.0% by mass of one or two or more selected from As, Sb, Be, B, Ti, Zr, Al and Fe can be added to the Cu—Ni—Si—Co copper alloy according to the present invention. However, since less than 0.001% by mass will only have a small effect, preferably a total of 0.001-2.0% by mass, more preferably a total of 0.05-1.0% by mass is added.

Since manufacturability is prone to be lost when the above-described addition amounts of Mg, Mn, Ag, P, Sn, Zn, As, Sb, Be, B, Ti, Zr, Al and Fe in total exceed 3.0% by mass, preferably the total of these is 2.0% by mass or less, more preferably 1.5% by mass or less.

Crystal Orientation

In one embodiment of the copper alloy strip according to the invention, when the ratio of diffraction intensity of β to that of copper powder is obtained at each α by X-ray diffraction pole figure measurement using a rolled surface as a base, the ratio of a peak height at α=20° and β=145° in a {200} pole figure to that of standard copper powder (hereinafter referred to as "peak height ratio of β angle 145° at α=20°") is not more than 5.2 times.

Preferably, the peak height ratio of β angle 145° at α=20° may not be more than 5.0 times, more preferably not more than 4.8 times, and even more preferably the peak height ratio may be 3.5-5.2. The standard copper powder is defined as a copper powder with a purity of 99.5% having a size of 325 mesh (JIS Z8801).

In one embodiment of the copper alloy strip according to the invention, when the ratio of diffraction intensity of β to that of copper powder is obtained at each α by X-ray diffraction pole figure measurement using a rolled surface as a base, the ratio of a peak height at α=75° and β=185° in a {111} pole figure to that of standard copper powder (hereinafter referred to as "peak height ratio of β angle 185° at α=75°") is not more than 3.4 times.

Preferably, the peak height ratio of β angle 185° at α=75° may not be less than 3.6, more preferably not less than 3.8, and even more preferably the peak height ratio may be 3.4-5.0. The standard copper powder is defined as a copper powder with a purity of 99.5% having a size of 325 mesh (JIS Z8801).

Strength and electrical conductivity can be improved in good balance and the drooping curl can be prevented by controlling the peak height of β angle 145° at α=20° at diffraction peak in {200} Cu surface and the peak height of β angle 185° at α=75° at diffraction peak in {111} Cu surface. Although the reason is not necessarily clear, this is a mere guess, it may be considered to be due to conducting the first aging treatment in 3 aging stages so that rolling strain is likely to be accumulated by rolling in next process because of the growth of the second phase particles precipitated in the first stage and the second stage, and of the second phase particles precipitated in the third stage.

The peak height of β angle 145° at α=20° in diffraction peak of {200} Cu surface and the peak height of β angle 185° at α=75° in diffraction peak of {111} Cu surface are measured by using pole figure measurement. The pole figure measurement is a measuring method comprising steps of selecting a certain diffraction surface {hkl} Cu, performing stepwise α-axis scanning for the 2θ values of the selected {hkl} Cu surface (by fixing the scanning angle 2θ of the detector), and subjecting the sample to β-axis scanning (in-plane rotation (spin) from 0° to 360°) for various α values. Meanwhile, in the XRD pole figure measurement of the present invention, the perpendicular direction relative to the sample surface is defined as α 90° and is used as the reference of measurement. Also, the pole figure measurement is carried out by a reflection method (α: −15° to 90°).

The peak height of β angle 185° at α=75° in diffraction peak of {111} Cu surface can be measured by reading the peak value of β angle 185° from the plotted intensities of β angle at α=75°. The peak height of β angle 145° at α=20° in diffraction peak of {200} Cu surface can be measured by reading the peak value of β angle 145° from the plotted intensities of β angle at α=75°.

Properties

In one embodiment, when Ni content (% by mass) is represented by [Ni], Co content (% by mass) is represented by [Co] and 0.2% yield strength is represented by YS (MPa), the copper alloy strip according to the present invention may satisfy a relationship expressed by the following formula: $-11\times([Ni]+[Co])^2+146\times([Ni]+[Co])+564\geq YS\geq-21\times([Ni]+[Co])^2+202\times([Ni]+[Co])+436$, Formula (i).

In a preferable embodiment, the copper alloy strip according to the present invention may satisfy a relationship expressed by the following formula: $-11\times([Ni]+[Co])^2+146\times([Ni]+[Co])+554\geq YS\geq-21\times([Ni]+[Co])^2+202\times([Ni]+[Co])+441$, Formula (i').

In a more preferable embodiment, the copper alloy strip according to the present invention may satisfy a relationship expressed by the following formula: $-11\times([Ni]+[Co])^2+146\times([Ni]+[Co])+554\geq YS\geq-21\times([Ni]+[Co])^2+202\times([Ni]+[Co])+450$, Formula (i").

In one embodiment of the copper alloy strip containing 0.03-0.5% by mass of Cr according to the present invention, when Ni content (% by mass) is represented by [Ni], Co content (% by mass) is represented by [Co] and 0.2% yield strength is represented by YS (MPa), the copper alloy strip may satisfy a relationship expressed by the following formula: $-14\times([Ni]+[Co])^2+164\times([Ni]+[Co])+551\geq YS\geq-22\times([Ni]+[Co])^2+204\times([Ni]+[Co])+447$, Formula (ii).

In a preferable embodiment of the copper alloy strip containing 0.03-0.5% by mass of Cr according to the present invention, the copper alloy strip may satisfy a relationship expressed by the following formula: $-14\times([Ni]+[Co])^2+164\times([Ni]+[Co])+541\geq YS\geq-22\times([Ni]+[Co])^2+204\times([Ni]+[Co])+452$, Formula (ii').

In a more preferable embodiment of the copper alloy strip containing 0.03-0.5% by mass of Cr according to the present invention, the copper alloy strip may satisfy a relationship expressed by the following formula: $-14\times([Ni]+[Co])^2+164\times([Ni]+[Co])+531\geq YS\geq-21\times([Ni]+[Co])^2+198\times([Ni]+[Co])+462$, Formula (ii").

In one embodiment of the copper alloy strip according to the present invention, a measurement of drooping curl in a direction parallel to a rolling direction may not be more than 35 mm, preferably not more than 20 mm, more preferably not more than 15 mm, and for example the drooping curl may be 10-30 mm.

In the present invention, the drooping curl in a direction parallel to a rolling direction can be measured by the following procedure. Elongate sample used for measurement which is 500 mm long in a longitudinal direction parallel to the rolling direction and 10 mm long in a width direction normal to the rolling direction is cut out of the strip used in the measurement. While the sample is grasped at one end and dropped at the other end, amount of warp toward vertical line at the other end is measured as the drooping curl. Although the drooping curl may be measured as mentioned above in the present invention, measurements of the drooping curl are rarely different in the case using elongate sample which is 500-1000 mm long in a longitudinal direction parallel to the rolling direction and 10-50 mm long in a width direction normal to the rolling direction.

In one embodiment, when 0.2% yield strength is represented by YS (MPa) and electrical conductivity is represented by EC (% IACS), the copper alloy strip according to the present invention may satisfy a relationship of 673≤YS≤976 and 42.5≤EC≤57.5, and a relationship expressed by the following formula: −0.0563×[YS]+94.1972≤EC≤−0.0563×[YS]+98.7040, Formula (iii). In a preferable embodiment, the copper alloy strip according to the present invention may satisfy a relationship of 683≤YS≤966 and 43≤EC≤57, and a relationship expressed by the following formula: −0.0563×[YS]+94.7610≤EC≤−0.0563×[YS]+98.1410, Formula (iii'). In a more preferable embodiment, the copper alloy strip according to the present invention may satisfy a relationship of 693≤YS≤956 and 43.5≤EC≤56.5, and a relationship expressed by the following formula: −0.0563×[YS]+95.3240≤EC≤−0.0563×[YS]+97.5770, Formula (iii").

In one embodiment of the copper alloy strip containing 0.03-0.5% by mass of Cr according to the present invention, when 0.2% yield strength is represented by YS (MPa) and electrical conductivity is represented by EC (% IACS), the copper alloy strip according to the present invention may satisfy a relationship of 679≤YS≤982 and 43.5≤EC≤59.5, and a relationship expressed by the following formula: −0.0610×[YS]+99.7465≤EC≤−0.0610×[YS]+104.6291, Formula (iv). In a preferable embodiment of the copper alloy strip containing 0.03-0.5% by mass of Cr according to the present invention, the copper alloy strip may satisfy a relationship of 689≤YS≤972 and 44≤EC≤59, and a relationship expressed by the following formula: −0.0610×[YS]+100.3568≤EC≤−0.0610×[YS]+104.0188, Formula (iv'). In a more preferable embodiment, the copper alloy strip according to the present invention may satisfy a relationship of 699≤YS≤962 and 44.5≤EC≤58.5, and a relationship expressed by the following formula: −0.0610×[YS]+100.9671≤EC≤−0.0610×[YS]+103.4085, Formula (iv").

Distribution Condition for Second Phase Particles

In the present invention, second phase particles refer mainly to silicides and include, but not limited to, crystallizations produced during solidification process of casting and precipitates produced in the subsequent cooling process, precipitates produced in the cooling process following hot rolling, precipitates produced in the cooling process following solutionizing, as well as precipitates produced in the aging treatment process.

In a preferable embodiment of Cu—Ni—Si—Co copper alloy according to the present invention, distribution of the second phase particles having a particle size of 0.1 μm to 1 μm is controlled. This further improves the balance between strength, electrical conductivity and drooping curl. In particular, the number density of the second phase particles having a particle size of 0.1 μm to 1 μm is $5\times10^5$ to $1\times10^7/mm^2$, preferably $1\times10^6$ to $10\times10^6/mm^2$, more preferably $5\times10^6$ to $10\times10^6/mm^2$.

In the present invention, the particle size of the second phase particles refers to the diameter of the smallest circle that encompasses the second-phase particles when the second phase particles are observed under the conditions described below.

The number density of the second-phase particles size of 0.1 □m or greater and 1 μm or less can be observed by jointly using electron microscope by which particles can be observed at high power (for example at magnification ratio of 3000 times) such as FE-EPMA or FE-SEM and image analysis software, that is possible to measure the number or the particle size. To adjust material under test, the matrix phase may be etched in accordance with a general electrolytic polishing condition that dissolution of the particles precipitated in the composition according to the present invention does not occur so as to produce an eruption of the second-phase particles. The observation surface is not designate as rolling surface or cross-section surface.

Manufacturing Method

With general manufacturing processes for Corson copper alloys, firstly electrolytic cathode copper, Ni, Si, Co, and other starting materials are melted in a melting furnace to obtain a molten metal having the desired composition. The molten metal is then cast into an ingot. Hot rolling is carried out thereafter, cold rolling and heat treatment are repeated, and a strip or a foil having a desired thickness and characteristics are finished. The heat treatment includes solution treatment and aging treatment. In the solution treatment, material is heated at a high temperature of about 700° C. to about 1000° C., the second-phase particles are solved in the Cu matrix, and the Cu matrix is simultaneously caused to recrystallize. Hot rolling is sometimes conducted as the solution treatment. In the aging treatment, material is heated for 1 hour or more in a temperature range of about 350 to about 550° C., and second-phase particles formed into a solid solution in the solution treatment are precipitated as fine particles on a nanometer order. The aging treatment results in increased strength and electrical conductivity. Cold rolling is sometimes performed before and/or after the aging treatment in order to obtain higher strength. Also, stress relief annealing (low-temperature annealing) is sometimes performed after cold rolling in the case that cold rolling is carried out after aging.

Grinding, polishing, shot blast, pickling, and the like may be carried out as needed in order to remove oxidized scale on the surface as needed between each of the above-described steps.

The manufacturing process described above is also used in the copper alloy according to the present invention, and it is important to strictly control solution treatment and subsequent process in order obtain the properties of copper alloy produced finally, which fall within the range in the present invention. This is because the Cu—Ni—Co—Si alloy of the present invention is different from conventional Cu—Ni—Si-based Corson alloys in that Co (Cr as well, in some cases), which makes the second-phase particles difficult to control, is aggressively added as an essential component for age precipitation hardening. This is due to the fact that the generation and growth rate are sensitive to the holding temperature and cooling rate during heat treatment although the second-phase particles are formed by the added Co together with Ni and Si.

First, coarse crystallites are unavoidably generated in the solidification process at the time of casting, and coarse precipitates are unavoidably generated in the cooling process. Therefore, the second-phase particles must form a solid solution in the matrix in the steps that follow. The material is held for 1 hour or more at 950° C. to 1050° C. and then subjected to hot rolling, and when the temperature at the end of hot rolling is set to 850° C. or higher, a solid solution can be formed in the matrix even when Co, and Cr as well, have been added. The temperature condition of 950° C. or higher is a higher temperature setting than in the case of other Corson alloys. When the holding temperature prior to hot rolling is less than 950° C., the solid solution in inadequate, and when the temperature is greater than 1050° C., it is possible that the material will melt. When the temperature at the end of hot rolling is less than 850° C., it is difficult to obtain high strength because the elements, which have formed a solid solution, will precipitate again. Therefore, it is preferred that hot rolling be ended at 850° C. or more and the material be rapidly cooled in order to obtain high strength.

Specifically, the cooling rate established when the temperature of the material is reduced from 850° C. to 400° C. after hot rolling may be 15° C./s or greater, preferably 18° C./s or greater, e.g., 15 to 25° C./s, and typically 15 to 20° C./s. In the present invention, "the average cooling rate from 850° C. to 400° C." after hot rolling refers to the value (° C./s) calculated from "(850-400) (° C.)/cooling time (s)" by measuring a time required to decrease the material temperature from 850° C. to 400° C.

The goal in the solution treatment is to cause crystallized particles during casting and precipitation particles following hot rolling to solve into a solid solution and to enhance age hardening capability in the solution treatment and thereafter. In this case, the holding temperature and time during solution treatment and the cooling rate after holding are important for controlling the number density of the second-phase particles. In the case that the holding time is constant, crystallized particles during casting and precipitation particles following hot rolling can be solved into a solid solution when the holding temperature is high, and the surface area ratio can be reduced.

The solution treatment may be conducted by using any one of a continuous-type or a batch-type annealing furnace, and may preferably be conducted by the continuous-type furnace from the viewpoint of production efficiency in the case that the strip like the present invention is produced industrially.

A faster cooling rate after the solution treatment can suppress precipitation during cooling more effectively. If the cooling rate is too slow, the second phase particles become coarse during cooling, and the contents of Ni, Co and Si in the second phase particles increase. Therefore, sufficient solid solution cannot be formed by the solution treatment, and the aging hardenability can be decreased. Accordingly, the cooling after the solution treatment is preferably carried out by rapid cooling. Specifically, after a solution treatment at 850° C. to 1050° C. for 10 s to 3600 s, it is effective to perform cooling to 400° C. at an average cooling rate of 10° C. or more per second, preferably 15° C. or more per second, and more preferably 20° C. or more per second. However, on the contrary, if the average cooling rate is increased too high, a strength increasing effect may not be sufficiently obtained. Therefore, the cooling rate is preferably 30° C. or less per second, and more preferably 25° C. or less per second. Here, the "average cooling rate" refers to the value (° C./sec) obtained by measuring the cooling time taken from the solution treatment temperature to 400° C., and calculating the value by the formula: "(solution treatment temperature−400) (° C.)/cooling time (seconds)".

With regard to the cooling conditions after the solution treatment, it is more preferable to set the two-stage cooling conditions as described in Patent Document 1. That is, after the solution treatment, it is desirable to employ two-stage cooling in which mild cooling is carried out over the range of from 850° C. to 650° C., and thereafter, rapid cooling is carried out over the range of from 650° C. to 400° C. Thereby, strength and electrical conductivity are further enhanced.

Specifically, after the solution treatment at 850° C. to 1050° C., the average cooling rate at which the material temperature falls from the solution treatment temperature to 650° C. is controlled to higher than or equal to 1° C./s and lower than 15° C./s, and preferably from 5° C./s to 12° C./s, and the average cooling rate employed when the material temperature falls from 650° C. to 400° C. is controlled to 15° C./s or higher, preferably 18° C./s or higher, for example, 15° C./s to 25° C./s, and typically 15° C./s to 20° C./s. Meanwhile, since precipitation of the second phase particles occurs significantly up to about 400° C., the cooling rate at a temperature of lower than 400° C. does not matter.

In regard to the control of the cooling rate after the solution treatment, the cooling rate can be adjusted by providing a slow cooling zone and a cooling zone adjacently to the heating zone that has been heated in the range of 850° C. to 1050° C., and adjusting the retention time for the respective zones. In the case where rapid cooling is needed, water quench may be carried out as the cooling method, and in the case of mild cooling, a temperature gradient may be provided inside the furnace.

The "average cooling rate (at which the temperature) falls to 650° C." after the solution treatment refers to the value (° C./s) obtained by measuring the cooling time taken for the temperature to fall from the material temperature maintained in the solution treatment to 650° C., and calculating the value by the formula: "(solution treatment temperature−650) (° C.)/cooling time (s)". The "average cooling rate (for the temperature) to fall from 650° C. to 400° C." similarly means the value (° C./s) calculated by the formula: "(650−400) (° C.)/cooling time (s)".

If only the cooling rate after the solution treatment is controlled without managing the cooling rate after hot rolling, coarse second phase particles cannot be sufficiently suppressed by a subsequent aging treatment. The cooling rate after hot rolling and the cooling rate after the solution treatment all need to be controlled.

Regarding a method of performing cooling rapidly, water cooling is most effective. However, since the cooling rate changes with the temperature of water used in water quenching, cooling can be achieved more rapidly by managing the water temperature. If the water temperature is 25° C. or higher, the desired cooling rate may not be obtained in some cases, and thus it is preferable to maintain the water temperature at 25° C. or lower. When the material is water-quenched by placing the material in a tank in which water is collected, the temperature of water is likely to increase to 25° C. or higher. Therefore, it is preferable to prevent an increase in the water temperature, so that the material would be cooled to a certain water temperature (25° C. or lower), by spraying water in a spray form (in a shower form or a mist form), or causing cold water to flow constantly to the water tank. Furthermore, the cooling rate can be increased by extending the number of water cooling nozzles or by increasing the amount of water per unit time.

In manufacturing the Cu—Ni—Co—Si alloy according to the present invention, it is effective to perform aging treatment, cold rolling and selective temper annealing in sequence and perform the aging treatment at 3-stage aging under specific conditions of temperature and time. That is, strength and electrical conductivity are enhanced by employing the 3-stage aging, and drooping curl is reduced by performing cold rolling thereafter. It may be considered that the reason why strength and electrical conductivity are enhanced significantly by conducting the aging treatment following solutionizing in 3 aging stages is that because of the growth of the second phase particles precipitated in the first stage and the second stage, and of the second phase particles precipitated in the third stage, rolling strain is likely to be accumulated by rolling in next process.

Regarding the 3-stage aging, first, a first stage is carried out by heating the material for 1 to 12 hours by setting the material temperature to 400° C. to 500° C., preferably heating the material for 2 to 10 hours by setting the material temperature to 420° C. to 480° C., and more preferably heating the material for 3 to 8 hours by setting the material temperature to 440° C. to 460° C. In the first stage, it is intended to increase strength and electrical conductivity by nucleation and growth of the second phase particles.

If the material temperature is lower than 400° C. or the heating time is less than 1 hour in the first stage, the volume fraction of the second phase particles is small, and desired strength and electrical conductivity cannot be easily obtained. On the other hand, if heating has been carried out until the material temperature reaches above 500° C., or if the heating time has exceeded 12 hours, the volume fraction of the second phase particles increases, but the particles become coarse, so that the strength strongly tends to decrease.

After completion of the first stage, the temperature of the aging treatment is changed to the aging temperature of the second stage at a cooling rate of 1° C./min to 8° C./min, preferably 3° C./min to 8° C./min, and more preferably 6° C./min to 8° C./min. The cooling rate is set to such a cooling rate for the reason that the second phase particles precipitated out in the first stage should not be excessively grown. The cooling rate as used herein is measured by the formula: (first stage aging temperature-second stage aging treatment) (° C.)/(cooling time (minutes) taken for the aging temperature to reach from the first stage aging temperature to the second stage aging temperature).

Subsequently, the second stage is carried out by heating the material for 1 to 12 hours by setting the material temperature to 350° C. to 450° C., preferably heating the material for 2 to 10 hours by setting the material temperature to 380° C. to 430° C., and more preferably heating the material for 3 to 8 hours by setting the material temperature to 400° C. to 420° C. In the second stage, it is intended to increase electrical conductivity by growing the second phase particles precipitated out in the first stage to the extent that contributes to strength, and to increase strength and electrical conductivity by precipitating fresh second phase particles in the second stage (smaller than the second phase particles precipitated in the first stage).

If the material temperature is lower than 350° C. or the heating time is less than one hour in the second stage, since the second phase particles precipitated out in the first stage cannot be grown, it is difficult to increase electrical conductivity, and since new second phase particles cannot be precipitated out in the second stage, strength and electrical conductivity cannot be increased. On the other hand, if heating has been carried out until the material temperature reaches above 450° C. or if the heating time has exceeded 12 hours, the second phase particles that have precipitated out in the first stage grow excessively and become coarse, or strength decreases.

If the temperature difference between the first stage and the second stage is too small, the second phase particles that have precipitated out in the first stage become coarse, causing a decrease in strength. On the other hand, if the temperature difference is too large, the second phase particles that have precipitated out in the first stage hardly grow, and electrical conductivity cannot be increased. Furthermore, since it is difficult for the second phase particles to precipitate out in the second phase, strength and electrical conductivity cannot be increased. Therefore, the temperature difference between the first stage and the second stage should be adjusted to 20° C. to 60° C., preferably to 20° C. to 50° C., and more preferably to 20° C. to 40° C.

For the same reason described above, after completion of the second stage, the temperature of the aging treatment is changed to the aging temperature of the third stage at a cooling rate of 1° C./min to 8° C./min, preferably 3° C./min to 8° C./min, and more preferably 6° C./min to 8° C./min. The cooling rate as used herein is measured by the formula: (second stage aging temperature-third stage aging treatment) (° C.)/(cooling time (minutes) taken for the aging temperature to reach from the second stage aging temperature to the third stage aging temperature).

Subsequently, the third stage is carried out by heating the material for 4 to 30 hours by setting the material temperature to 260° C. to 340° C., preferably heating the material for 6 to 25 hours by setting the material temperature to 290° C. to 330° C., and more preferably heating the material for 8 to 20 hours by setting the material temperature to 300° C. to 320° C. In the third stage, it is intended to slightly grow the second phase particles that have precipitated out in the first stage and the second stage, and to produce fresh second phase particles.

If the material temperature is lower than 260° C. or the heating time is less than 4 hours in the third stage, the second phase particles that have precipitated out in the first stage and the second stage cannot be grown, and new second phase particles cannot be produced. Therefore, it is difficult to obtain desired strength, electrical conductivity and spring bending elastic limit. On the other hand, if heating has been carried out until the material temperature reaches above 340° C. or if the heating time has exceeded 30 hours, the second phase particles that have precipitated out in the first stage and the second stage grow excessively and become coarse, and therefore, it is difficult to obtain desired strength.

If the temperature difference between the second stage and the third stage is too small, the second phase particles that have precipitated out in the first stage and second stage become coarse, causing a decrease in strength. On the other hand, if the temperature difference is too large, the second phase particles that have precipitated out in the first stage and the second stage hardly grow, and electrical conductivity cannot be increased. Furthermore, since it is difficult for the second phase particles to precipitate out in the third stage, strength and electrical conductivity cannot be increased. Therefore, the temperature difference between the second stage and the third stage should be adjusted to 20° C. to 180° C., preferably to 50° C. to 135° C., and more preferably to 70° C. to 120° C.

In each stage of aging treatment, since the distribution of the second phase particles undergoes change, the temperature is in principle maintained constant. However, it does not matter even if there is a fluctuation of about plus or minus 5° C. relative to the set temperature. Thus, the respective steps are carried out with a temperature deviation width of 10° C. or less.

After the aging treatment, cold rolling is carried out. In this cold rolling, insufficient aging hardening achieved by the aging treatment can be supplemented by work hardening, and cold rolling has the effect of reducing curling tendency resulting from aging treatment, which causes drooping curl. The degree of working ratio (draft ratio) at this time is 10% to 80%, and preferably 20% to 60%, in order to reach a desired strength level and to reduce curling tendency. If the working ratio is too large, negative effect of reduction of bendability is caused. On the other hand, If the working ratio is too small, the suppression of drooping curl tends to be insufficiency.

There is no need to conduct further heating treatment after the cold rolling. Conducting heating treatment once again may lead to a fear that the curling tendency which was reduced by the cold rolling is reversed. However, temper annealing can be conducted.

The temper annealing may be conducted within the temperature range of 200° C. to 500° C. for 1 to 1000 seconds. The temper annealing can improve spring property.

The Cu—Ni—Si—Co copper alloy strip of the present invention can be processed into various wrought copper and copper alloy products, for example, strips, foils, tubes, bars and wires, and further, the Cu—Ni—Si—Co copper alloy according to the present invention can be used in electronic components such as lead frames, connectors, pins, terminals, relays, switches, and foils for secondary battery.

The thickness of the copper alloy strip according to the present invention may be 0.005 mm to 1.500 mm, preferably 0.030 mm to 0.900 mm, more preferably 0.040 mm to 0.800 mm, further preferably 0.050 mm to 0.400 mm, but not be limited to these ranges.

EXAMPLES

Hereinafter, Examples of the present invention are described together with Comparative Examples. These Examples are provided for facilitating understanding of the present invention and the advantages thereof, and are not intended to limit the scope of the invention.

Effect of Aging Conditions on Alloy Characteristics

A copper alloy (10 kg) having the composition shown in Table 1, with the balance being copper and impurities, was melted in a high-frequency melting furnace at 1300° C., and then cast into an ingot having a thickness of 30 mm. Next, the ingot was heated at 1000° C. for 3 hours, and hot rolled thereafter at a finishing temperature (the temperature at the completion of hot rolling) of 900° C. to obtain a plate thickness of 10 mm. After completion of the hot rolling, the resultant was cooled rapidly to 400° C. at a cooling rate of 15° C./s. Subsequently, the resultant was left to stand in air to cool. Subsequently, the resultant was subjected to surface grinding to a thickness of 9 mm in order to remove scale at the surface, and then was processed into a plate having a length of 80 m, width of 50 mm and thickness of 0.286 mm by cold rolling. Subsequently, a solution treatment was carried out at 950° C. for 120 seconds, and thereafter, the resultant was cooled. The cooling conditions were such that in Examples No. 1 to 136 and Comparative Examples No. 1 to 173 and 186 to 191, water cooling was carried out from the solution treatment temperature to 400° C. at an average cooling rate of 20° C./s; and in Examples No. 137 to 154 and Comparative Examples No. 174 to 185, the cooling rate employed to drop the temperature from the solution treatment temperature to 650° C. was set at 5° C./s, and the average cooling rate employed to drop the temperature from 650° C. to 400° C. was set at 18° C./s. Thereafter, the material was cooled by leaving the material to stand in air. Subsequently, the first aging treatment was applied under the various conditions indicated in Table 2 in an inert atmosphere. Thereafter, cold rolling was carried out to obtain a thickness of 0.20 mm (reduction ratio: 30%). Finally, with some materials wound like a coil in an inert atmosphere in a batch-type furnace, temper annealing under the condition shown in Table 3 or a second aging treatment was carried out and thus each of the specimens was produced. In Comparative Examples No. 190 and 191, cold rolling (reduction ratio: 20%) was further conducted after the second aging treatment. In the case that the multiple-stage aging treatment was carried out, the material temperature in the respective stages was maintained within ±3° C. from the set temperature indicated in Tables 2 and 3.

TABLE 1-1

| No | Composition (mass %) | | | | | |
|---|---|---|---|---|---|---|
| Example | Ni | Co | Si | Cr | others | Ni + Co |
| 1 | 1.8 | 1.0 | 0.65 | — | — | 2.8 |
| 2 | | | | | | |
| 3 | | | | | | |
| 4 | | | | | | |
| 5 | | | | | | |
| 6 | | | | | | |
| 7 | | | | | | |
| 8 | | | | | | |
| 9 | | | | | | |
| 10 | | | | | | |
| 11 | | | | | | |
| 12 | | | | | | |
| 13 | | | | | | |
| 14 | | | | | | |
| 15 | | | | | | |
| 16 | | | | | | |
| 17 | | | | | | |
| 18 | | | | | | |
| 19 | | | | | | |
| 20 | | | | | | |
| 21 | | | | | | |
| 22 | | | | | | |
| 23 | | | | | | |
| 24 | | | | | | |
| 25 | | | | | | |
| 26 | | | | | | |
| 27 | | | | | | |
| 28 | | | | | | |
| 29 | | | | | | |
| 30 | | | | | | |
| 31 | | | | | | |
| 32 | | | | | | |
| 33 | | | | | | |
| 34 | | | | | | |
| 35 | | | | | | |
| 36 | | | | | | |
| 37 | | | | | | |
| 38 | | | | | | |
| 39 | | | | | | |
| 40 | | | | | | |
| 41 | | | | | | |
| 42 | | | | | | |
| 43 | | | | | | |
| 44 | | | | | | |
| 45 | | | | | | |

TABLE 1-2

| No | Composition (mass %) | | | | | |
|---|---|---|---|---|---|---|
| Example | Ni | Co | Si | Cr | others | Ni + Co |
| 46 | 1.8 | 1.0 | 0.65 | 0.1 | — | 2.8 |
| 47 | | | | | | |
| 48 | | | | | | |
| 49 | | | | | | |
| 50 | | | | | | |
| 51 | | | | | | |
| 52 | | | | | | |
| 53 | | | | | | |
| 54 | | | | | | |
| 55 | | | | | | |
| 56 | | | | | | |
| 57 | | | | | | |
| 58 | | | | | | |
| 59 | | | | | | |
| 60 | | | | | | |
| 61 | | | | | | |
| 62 | | | | | | |
| 63 | | | | | | |
| 64 | | | | | | |
| 65 | | | | | | |
| 66 | | | | | | |

TABLE 1-2-continued

| No | Composition (mass %) | | | | | |
|---|---|---|---|---|---|---|
| Example | Ni | Co | Si | Cr | others | Ni + Co |
| 67 | | | | | | |
| 68 | | | | | | |
| 69 | | | | | | |
| 70 | | | | | | |
| 71 | | | | | | |
| 72 | | | | | | |
| 73 | | | | | | |
| 74 | | | | | | |
| 75 | | | | | | |
| 76 | | | | | | |
| 77 | | | | | | |
| 78 | | | | | | |
| 79 | | | | | | |
| 80 | | | | | | |
| 81 | | | | | | |
| 82 | | | | | | |
| 83 | | | | | | |
| 84 | | | | | | |
| 85 | | | | | | |
| 86 | | | | | | |
| 87 | | | | | | |
| 88 | | | | | | |
| 89 | | | | | | |
| 90 | | | | | | |

TABLE 1-3

| No | Composition (mass %) | | | | | |
|---|---|---|---|---|---|---|
| Example | Ni | Co | Si | Cr | others | Ni + Co |
| 91 | 1 | 0.5 | 0.34 | — | — | 1.5 |
| 92 | | | | | | |
| 93 | | | | | | |
| 94 | 2.5 | 1.5 | 0.91 | — | — | 4 |
| 95 | | | | | | |
| 96 | | | | | | |
| 97 | 1 | 0.5 | 0.34 | 0.1 | — | 1.5 |
| 98 | | | | | | |
| 99 | | | | | | |
| 100 | 2.5 | 1.5 | 0.91 | 0.1 | — | 4 |
| 101 | | | | | | |
| 102 | | | | | | |
| 103 | 1.8 | 1.0 | 0.65 | — | 0.5Sn | 2.8 |
| 104 | | | | | | |
| 105 | | | | | | |
| 106 | 1.8 | 1.0 | 0.65 | — | 0.5Zn | 2.8 |
| 107 | | | | | | |
| 108 | | | | | | |
| 109 | 1.8 | 1.0 | 0.65 | — | 0.1Ag | 2.8 |
| 110 | | | | | | |
| 111 | | | | | | |
| 112 | 1.8 | 1.0 | 0.65 | — | 0.1Mg | 2.8 |
| 113 | | | | | | |
| 114 | | | | | | |
| 115 | 1.8 | 1.0 | 0.65 | 0.1 | 0.5Sn | 2.8 |
| 116 | | | | | | |
| 117 | | | | | | |
| 118 | 1.8 | 1.0 | 0.65 | 0.1 | 0.5Zn | 2.8 |
| 119 | | | | | | |
| 120 | | | | | | |
| 121 | 1.8 | 1.0 | 0.65 | 0.1 | 0.1Ag | 2.8 |
| 122 | | | | | | |
| 123 | | | | | | |
| 124 | 1.8 | 1.0 | 0.65 | 0.1 | 0.1Mg | 2.8 |
| 125 | | | | | | |
| 126 | | | | | | |
| 127 | 1.8 | 1.0 | 0.65 | | 0.5Mn, 0.1Mg, 0.5Zn, 0.5Ag | 2.8 |
| 128 | 2.5 | 2.5 | 1.1 | — | — | 5.0 |
| 129 | 1.8 | 1.0 | 0.65 | 0.5 | — | 2.8 |

TABLE 1-4

| No | Composition (mass %) | | | | | |
|---|---|---|---|---|---|---|
| Example | Ni | Co | Si | Cr | others | Ni + Co |
| 130 | 1.8 | 1.0 | 0.65 | 0.1 | 0.01.P, 0.01As, 0.01Sb, 0.01Be, 0.01B, 0.01Ti, 0.01Zr, 0.01Al, 0.01Fe, 0.01Zn | 2.8 |
| 131 | 1.8 | 1.0 | 0.65 | — | — | 2.8 |
| 132 | 1.8 | 1.0 | 0.65 | — | — | 2.8 |
| 133 | 1.8 | 1.0 | 0.65 | — | — | 2.8 |
| 134 | 1.8 | 1.0 | 0.65 | — | — | 2.8 |
| 135 | 1.8 | 1.0 | 0.65 | — | — | 2.8 |
| 136 | 1.8 | 1.0 | 0.65 | 0.5 | — | 2.8 |
| 137 | 1.8 | 1.0 | 0.65 | — | — | 2.8 |
| 138 | 1.8 | 1.0 | 0.65 | — | — | 2.8 |
| 139 | 1.8 | 1.0 | 0.65 | — | — | 2.8 |
| 140 | 1.8 | 1.0 | 0.65 | 0.1 | — | 2.8 |
| 141 | 1.8 | 1.0 | 0.65 | 0.1 | — | 2.8 |
| 142 | 1.8 | 1.0 | 0.65 | 0.1 | — | 2.8 |
| 143 | 1.0 | 0.5 | 0.34 | — | — | 1.5 |
| 144 | 1.0 | 0.5 | 0.34 | — | — | 1.5 |
| 145 | 1.0 | 0.5 | 0.34 | — | — | 1.5 |
| 146 | 1.0 | 0.5 | 0.34 | 0.1 | — | 1.5 |
| 147 | 1.0 | 0.5 | 0.34 | 0.1 | — | 1.5 |
| 148 | 1.0 | 0.5 | 0.34 | 0.1 | — | 1.5 |
| 149 | 2.5 | 1.5 | 0.91 | — | — | 4.0 |
| 150 | 2.5 | 1.5 | 0.91 | — | — | 4.0 |
| 151 | 2.5 | 1.5 | 0.91 | — | — | 4.0 |
| 152 | 2.5 | 1.5 | 0.91 | 0.1 | — | 4.0 |
| 153 | 2.5 | 1.5 | 0.91 | 0.1 | — | 4.0 |
| 154 | 2.5 | 1.5 | 0.91 | 0.1 | — | 4.0 |

TABLE 1-5

| No Comparative | Composition (mass %) | | | | | |
|---|---|---|---|---|---|---|
| Example | Ni | Co | Si | Cr | others | Ni + Co |
| 1 | 1.8 | 1 | 0.65 | — | — | 2.8 |
| 2 | | | | | | |
| 3 | | | | | | |
| 4 | | | | | | |
| 5 | | | | | | |
| 6 | | | | | | |
| 7 | | | | | | |
| 8 | | | | | | |
| 9 | | | | | | |
| 10 | | | | | | |
| 11 | | | | | | |
| 12 | | | | | | |
| 13 | | | | | | |
| 14 | | | | | | |
| 15 | | | | | | |
| 16 | | | | | | |
| 17 | | | | | | |
| 18 | | | | | | |
| 19 | | | | | | |
| 20 | | | | | | |
| 21 | | | | | | |
| 22 | | | | | | |
| 23 | | | | | | |
| 24 | | | | | | |
| 25 | | | | | | |
| 26 | | | | | | |
| 27 | | | | | | |
| 28 | | | | | | |
| 29 | | | | | | |
| 30 | | | | | | |
| 31 | | | | | | |
| 32 | | | | | | |
| 33 | | | | | | |
| 34 | | | | | | |
| 35 | | | | | | |
| 36 | | | | | | |
| 37 | | | | | | |

TABLE 1-5-continued

| No Comparative Example | Composition (mass %) | | | | | |
|---|---|---|---|---|---|---|
| | Ni | Co | Si | Cr | others | Ni + Co |
| 38 | | | | | | |
| 39 | | | | | | |
| 40 | | | | | | |
| 41 | | | | | | |
| 42 | | | | | | |
| 43 | | | | | | |
| 44 | | | | | | |
| 45 | | | | | | |
| 46 | | | | | | |
| 47 | | | | | | |
| 48 | | | | | | |
| 49 | | | | | | |

TABLE 1-6

| No Comparative Example | Composition (mass %) | | | | | |
|---|---|---|---|---|---|---|
| | Ni | Co | Si | Cr | others | Ni + Co |
| 50 | 1.8 | 1.0 | 0.65 | — | — | 2.8 |
| 51 | | | | | | |
| 52 | | | | | | |
| 53 | | | | | | |
| 54 | | | | | | |
| 55 | | | | | | |
| 56 | | | | | | |
| 57 | | | | | | |
| 58 | | | | | | |
| 59 | 1.8 | 1 | 0.65 | 0.1 | — | 2.8 |
| 60 | | | | | | |
| 61 | | | | | | |
| 62 | | | | | | |
| 63 | | | | | | |
| 64 | | | | | | |
| 65 | | | | | | |
| 66 | | | | | | |
| 67 | | | | | | |
| 68 | | | | | | |
| 69 | | | | | | |
| 70 | | | | | | |
| 71 | | | | | | |
| 72 | | | | | | |
| 73 | | | | | | |
| 74 | | | | | | |
| 75 | | | | | | |
| 76 | | | | | | |
| 77 | | | | | | |
| 78 | | | | | | |
| 79 | | | | | | |
| 80 | | | | | | |
| 81 | | | | | | |
| 82 | | | | | | |
| 83 | | | | | | |
| 84 | | | | | | |
| 85 | | | | | | |
| 86 | | | | | | |
| 87 | | | | | | |
| 88 | | | | | | |
| 89 | | | | | | |
| 90 | | | | | | |
| 91 | | | | | | |
| 92 | | | | | | |
| 93 | | | | | | |
| 94 | | | | | | |
| 95 | | | | | | |
| 96 | | | | | | |
| 97 | | | | | | |
| 98 | | | | | | |

TABLE 1-7

| No Comparative Example | Composition (mass %) | | | | | |
|---|---|---|---|---|---|---|
| | Ni | Co | Si | Cr | others | Ni + Co |
| 99 | 1.8 | 1 | 0.65 | 0.1 | — | 2.8 |
| 100 | | | | | | |
| 101 | | | | | | |
| 102 | | | | | | |
| 103 | | | | | | |
| 104 | | | | | | |
| 105 | | | | | | |
| 106 | | | | | | |
| 107 | | | | | | |
| 108 | | | | | | |
| 109 | | | | | | |
| 110 | | | | | | |
| 111 | | | | | | |
| 112 | | | | | | |
| 113 | | | | | | |
| 114 | | | | | | |
| 115 | | | | | | |
| 116 | | | | | | |
| 117 | | | | | | |
| 118 | | | | | | |
| 119 | | | | | | |
| 120 | | | | | | |
| 121 | | | | | | |
| 122 | | | | | | |
| 123 | | | | | | |
| 124 | | | | | | |
| 125 | | | | | | |
| 126 | 1 | 0.5 | 0.34 | — | — | 1.5 |
| 127 | | | | | | |
| 128 | | | | | | |
| 129 | | | | | | |
| 130 | 2.5 | 1.5 | 0.91 | — | — | 4 |
| 131 | | | | | | |
| 132 | | | | | | |
| 133 | | | | | | |
| 134 | 1 | 0.5 | 0.34 | 0.1 | — | 1.5 |
| 135 | | | | | | |
| 136 | | | | | | |
| 137 | | | | | | |
| 138 | 2.5 | 1.5 | 0.91 | 0.1 | — | 4 |
| 139 | | | | | | |
| 140 | | | | | | |
| 141 | | | | | | |
| 142 | 1.8 | 1.0 | 0.65 | — | 0.5Sn | 2.8 |
| 143 | | | | | | |
| 144 | | | | | | |
| 145 | | | | | | |
| 146 | 1.8 | 1.0 | 0.65 | — | 0.5Zn | 2.8 |
| 147 | | | | | | |
| 148 | | | | | | |
| 149 | | | | | | |

TABLE 1-8

| No Comparative Example | Composition (mass %) | | | | | |
|---|---|---|---|---|---|---|
| | Ni | Co | Si | Cr | others | Ni + Co |
| 150 | 1.8 | 1.0 | 0.65 | — | 0.1Ag | 2.8 |
| 151 | | | | | | |
| 152 | | | | | | |
| 153 | | | | | | |
| 154 | 1.8 | 1.0 | 0.65 | — | 0.1Mg | 2.8 |
| 155 | | | | | | |
| 156 | | | | | | |
| 157 | | | | | | |
| 158 | 1.8 | 1.0 | 0.65 | 0.1 | 0.5Sn | 2.8 |
| 159 | | | | | | |
| 160 | | | | | | |
| 161 | | | | | | |

TABLE 1-8-continued

| No Comparative Example | Composition (mass %) | | | | | |
|---|---|---|---|---|---|---|
| | Ni | Co | Si | Cr | others | Ni + Co |
| 162 | 1.8 | 1.0 | 0.65 | 0.1 | 0.5Zn | 2.8 |
| 163 | | | | | | |
| 164 | | | | | | |
| 165 | | | | | | |
| 166 | 1.8 | 1.0 | 0.65 | 0.1 | 0.1Ag | 2.8 |
| 167 | | | | | | |
| 168 | | | | | | |
| 169 | | | | | | |
| 170 | 1.8 | 1.0 | 0.65 | 0.1 | 0.1Mg | 2.8 |
| 171 | | | | | | |
| 172 | | | | | | |
| 173 | | | | | | |
| 174 | 1.8 | 1.0 | 0.65 | — | — | 2.8 |
| 175 | 1.8 | 1.0 | 0.65 | 0.1 | — | 2.8 |
| 176 | 1.8 | 1.0 | 0.65 | — | — | 2.8 |
| 177 | 1.8 | 1.0 | 0.65 | 0.1 | — | 2.8 |

TABLE 1-8-continued

| No Comparative Example | Composition (mass %) | | | | | |
|---|---|---|---|---|---|---|
| | Ni | Co | Si | Cr | others | Ni + Co |
| 178 | 1 | 0.5 | 0.34 | — | — | 1.5 |
| 179 | 1 | 0.5 | 0.34 | 0.1 | — | 1.5 |
| 180 | 1 | 0.5 | 0.34 | — | — | 1.5 |
| 181 | 1 | 0.5 | 0.34 | 0.1 | — | 1.5 |
| 182 | 2.5 | 1.5 | 0.91 | — | — | 4.0 |
| 183 | 2.5 | 1.5 | 0.91 | 0.1 | — | 4.0 |
| 184 | 2.5 | 1.5 | 0.91 | — | — | 4.0 |
| 185 | 2.5 | 1.5 | 0.91 | 0.1 | — | 4.0 |
| 186 | 1.8 | 1 | 0.65 | — | — | 2.8 |
| 187 | 1.8 | 1 | 0.65 | 0.1 | — | 2.8 |
| 188 | 1.8 | 1 | 0.65 | — | — | 2.8 |
| 189 | 1.8 | 1 | 0.65 | 0.1 | — | 2.8 |
| 190 | 1.8 | 1.0 | 0.65 | — | — | 2.8 |
| 191 | 1.8 | 1.0 | 0.65 | 0.5 | — | 2.8 |

TABLE 2-1

| No Example | First aging treatment | | | | | | | |
|---|---|---|---|---|---|---|---|---|
| | First stage tempreture (° C.) | First stage → Second stage cooling rate (° C./min) | Second stage tempreture (° C.) | Second stage →Third stage cooling rate (° C./min) | Third stage tempreture (° C.) | First stage time (hr) | Second stage time (hr) | Third stage time (hr) |
| 1 | 400 | 6 | 360 | 6 | 330 | 6 | 12 | 6 |
| 2 | | | | | | 6 | 12 | 10 |
| 3 | | | | | | 6 | 12 | 15 |
| 4 | | | | | | 12 | 6 | 6 |
| 5 | | | | | | 12 | 6 | 10 |
| 6 | | | | | | 12 | 6 | 15 |
| 7 | | | | | | 12 | 12 | 6 |
| 8 | | | | | | 12 | 12 | 10 |
| 9 | | | | | | 12 | 12 | 15 |
| 10 | 460 | | 420 | | 270 | 3 | 6 | 15 |
| 11 | | | | | | 3 | 6 | 25 |
| 12 | | | | | | 3 | 6 | 30 |
| 13 | | | | | | 6 | 6 | 15 |
| 14 | | | | | | 6 | 6 | 25 |
| 15 | | | | | | 6 | 6 | 30 |
| 16 | | | | | | 6 | 12 | 15 |
| 17 | | | | | | 6 | 12 | 25 |
| 18 | | | | | | 6 | 12 | 30 |
| 19 | 460 | | 420 | | 300 | 3 | 6 | 15 |
| 20 | | | | | | 3 | 6 | 10 |
| 21 | | | | | | 3 | 6 | 6 |
| 22 | | | | | | 6 | 6 | 6 |
| 23 | | | | | | 6 | 6 | 10 |
| 24 | | | | | | 6 | 6 | 15 |
| 25 | | | | | | 6 | 12 | 6 |
| 26 | | | | | | 6 | 12 | 10 |
| 27 | | | | | | 6 | 12 | 15 |
| 28 | 460 | | 420 | | 330 | 3 | 6 | 4 |
| 29 | | | | | | 3 | 6 | 6 |
| 30 | | | | | | 3 | 6 | 10 |
| 31 | | | | | | 6 | 6 | 4 |
| 32 | | | | | | 6 | 6 | 6 |
| 33 | | | | | | 6 | 6 | 10 |
| 34 | | | | | | 6 | 12 | 4 |
| 35 | | | | | | 6 | 12 | 6 |
| 36 | | | | | | 6 | 12 | 10 |
| 37 | 500 | | 450 | | 270 | 1 | 3 | 15 |
| 38 | | | | | | 1 | 3 | 25 |
| 39 | | | | | | 1 | 3 | 30 |
| 40 | | | | | | 1 | 6 | 15 |
| 41 | | | | | | 1 | 6 | 25 |
| 42 | | | | | | 1 | 6 | 30 |
| 43 | | | | | | 3 | 3 | 15 |
| 44 | | | | | | 3 | 3 | 25 |
| 45 | | | | | | 3 | 3 | 30 |

TABLE 2-2

| No Example | First aging treatment | | | | | | | |
|---|---|---|---|---|---|---|---|---|
| | First stage tempreture (° C.) | First stage → Second stage cooling rate (° C./min) | Second stage tempreture (° C.) | Second stage →Third stage cooling rate (° C./min) | Third stage tempreture (° C.) | First stage time (hr) | Second stage time (hr) | Third stage time (hr) |
| 46 | 400 | 6 | 360 | 6 | 330 | 6 | 12 | 6 |
| 47 | | | | | | 6 | 12 | 10 |
| 48 | | | | | | 6 | 12 | 15 |
| 49 | | | | | | 12 | 6 | 6 |
| 50 | | | | | | 12 | 6 | 10 |
| 51 | | | | | | 12 | 6 | 15 |
| 52 | | | | | | 12 | 12 | 6 |
| 53 | | | | | | 12 | 12 | 10 |
| 54 | | | | | | 12 | 12 | 15 |
| 55 | 460 | | 420 | | 270 | 3 | 6 | 15 |
| 56 | | | | | | 3 | 6 | 25 |
| 57 | | | | | | 3 | 6 | 30 |
| 58 | | | | | | 6 | 6 | 15 |
| 59 | | | | | | 6 | 6 | 25 |
| 60 | | | | | | 6 | 6 | 30 |
| 61 | | | | | | 6 | 12 | 15 |
| 62 | | | | | | 6 | 12 | 25 |
| 63 | | | | | | 6 | 12 | 30 |
| 64 | 460 | | 420 | | 300 | 3 | 6 | 15 |
| 65 | | | | | | 3 | 6 | 10 |
| 66 | | | | | | 3 | 6 | 6 |
| 67 | | | | | | 6 | 6 | 6 |
| 68 | | | | | | 6 | 6 | 10 |
| 69 | | | | | | 6 | 6 | 15 |
| 70 | | | | | | 6 | 12 | 6 |
| 71 | | | | | | 6 | 12 | 10 |
| 72 | | | | | | 6 | 12 | 15 |
| 73 | 460 | | 420 | | 330 | 3 | 6 | 4 |
| 74 | | | | | | 3 | 6 | 6 |
| 75 | | | | | | 3 | 6 | 10 |
| 76 | | | | | | 6 | 6 | 4 |
| 77 | | | | | | 6 | 6 | 6 |
| 78 | | | | | | 6 | 6 | 10 |
| 79 | | | | | | 6 | 12 | 4 |
| 80 | | | | | | 6 | 12 | 6 |
| 81 | | | | | | 6 | 12 | 10 |
| 82 | 500 | | 450 | | 270 | 1 | 3 | 15 |
| 83 | | | | | | 1 | 3 | 25 |
| 84 | | | | | | 1 | 3 | 30 |
| 85 | | | | | | 1 | 6 | 15 |
| 86 | | | | | | 1 | 6 | 25 |
| 87 | | | | | | 1 | 6 | 30 |
| 88 | | | | | | 3 | 3 | 15 |
| 89 | | | | | | 3 | 3 | 25 |
| 90 | | | | | | 3 | 3 | 30 |

TABLE 2-3

| No Example | First aging treatment | | | | | | | |
|---|---|---|---|---|---|---|---|---|
| | First stage tempreture (° C.) | First stage → Second stage cooling rate (° C./min) | Second stage tempreture (° C.) | Second stage →Third stage cooling rate (° C./min) | Third stage tempreture (° C.) | First stage time (hr) | Second stage time (hr) | Third stage time (hr) |
| 91 | 460 | 6 | 420 | 6 | 300 | 3 | 6 | 6 |
| 92 | | | | | | 3 | 6 | 10 |
| 93 | | | | | | 3 | 6 | 15 |
| 94 | 460 | | 420 | | 300 | 3 | 6 | 6 |
| 95 | | | | | | 3 | 6 | 10 |
| 96 | | | | | | 3 | 6 | 15 |
| 97 | 460 | | 420 | | 300 | 3 | 6 | 6 |
| 98 | | | | | | 3 | 6 | 10 |
| 99 | | | | | | 3 | 6 | 15 |
| 100 | 460 | | 420 | | 300 | 3 | 6 | 6 |
| 101 | | | | | | 3 | 6 | 10 |
| 102 | | | | | | 3 | 6 | 15 |

TABLE 2-3-continued

| No Example | First aging treatment | | | | | | | |
|---|---|---|---|---|---|---|---|---|
| | First stage tempreture (° C.) | First stage → Second stage cooling rate (° C./min) | Second stage tempreture (° C.) | Second stage →Third stage cooling rate (° C./min) | Third stage tempreture (° C.) | First stage time (hr) | Second stage time (hr) | Third stage time (hr) |
| 103 | 460 | | 420 | | 300 | 3 | 6 | 6 |
| 104 | | | | | | 3 | 6 | 10 |
| 105 | | | | | | 3 | 6 | 15 |
| 106 | 460 | | 420 | | 300 | 3 | 6 | 6 |
| 107 | | | | | | 3 | 6 | 10 |
| 108 | | | | | | 3 | 6 | 15 |
| 109 | 460 | | 420 | | 300 | 3 | 6 | 6 |
| 110 | | | | | | 3 | 6 | 10 |
| 111 | | | | | | 3 | 6 | 15 |
| 112 | 460 | | 420 | | 300 | 3 | 6 | 6 |
| 113 | | | | | | 3 | 6 | 10 |
| 114 | | | | | | 3 | 6 | 15 |
| 115 | 460 | | 420 | | 300 | 3 | 6 | 6 |
| 116 | | | | | | 3 | 6 | 10 |
| 117 | | | | | | 3 | 6 | 15 |
| 118 | 460 | | 420 | | 300 | 3 | 6 | 6 |
| 119 | | | | | | 3 | 6 | 10 |
| 120 | | | | | | 3 | 6 | 15 |
| 121 | 460 | | 420 | | 300 | 3 | 6 | 6 |
| 122 | | | | | | 3 | 6 | 10 |
| 123 | | | | | | 3 | 6 | 15 |
| 124 | 460 | | 420 | | 300 | 3 | 6 | 6 |
| 125 | | | | | | 3 | 6 | 10 |
| 126 | | | | | | 3 | 6 | 15 |
| 127 | 460 | 6 | 420 | 6 | 300 | 3 | 6 | 15 |
| 128 | 460 | 6 | 420 | 6 | 300 | 3 | 6 | 15 |
| 129 | 460 | 6 | 420 | 6 | 300 | 3 | 6 | 15 |

TABLE 2-4

| No Example | First aging treatment | | | | | | | |
|---|---|---|---|---|---|---|---|---|
| | First stage tempreture (° C.) | First stage → Second stage cooling rate (° C./min) | Second stage tempreture (° C.) | Second stage →Third stage cooling rate (° C./min) | Third stage tempreture (° C.) | First stage time (hr) | Second stage time (hr) | Third stage time (hr) |
| 130 | 460 | 6 | 420 | 6 | 300 | 3 | 6 | 15 |
| 131 | 460 | 2 | 420 | 2 | 300 | 3 | 6 | 15 |
| 132 | 460 | 8 | 420 | 8 | 300 | 3 | 6 | 15 |
| 133 | 460 | 2 | 420 | 8 | 300 | 3 | 6 | 15 |
| 134 | 460 | 8 | 420 | 2 | 300 | 3 | 6 | 15 |
| 135 | 460 | 6 | 420 | 6 | 300 | 3 | 6 | 15 |
| 136 | 460 | 6 | 420 | 6 | 300 | 3 | 6 | 15 |
| 137 | 460 | 6 | 420 | 6 | 300 | 3 | 6 | 10 |
| 138 | 460 | 6 | 420 | 6 | 300 | 3 | 6 | 15 |
| 139 | 460 | 6 | 420 | 6 | 300 | 6 | 12 | 6 |
| 140 | 460 | 6 | 420 | 6 | 300 | 3 | 6 | 10 |
| 141 | 460 | 6 | 420 | 6 | 300 | 3 | 6 | 15 |
| 142 | 460 | 6 | 420 | 6 | 300 | 6 | 12 | 6 |
| 143 | 460 | 6 | 420 | 6 | 300 | 3 | 6 | 10 |
| 144 | 460 | 6 | 420 | 6 | 300 | 3 | 6 | 15 |
| 145 | 460 | 6 | 420 | 6 | 300 | 6 | 12 | 6 |
| 146 | 460 | 6 | 420 | 6 | 300 | 3 | 6 | 10 |
| 147 | 460 | 6 | 420 | 6 | 300 | 3 | 6 | 15 |
| 148 | 460 | 6 | 420 | 6 | 300 | 6 | 12 | 6 |
| 149 | 460 | 6 | 420 | 6 | 300 | 3 | 6 | 10 |
| 150 | 460 | 6 | 420 | 6 | 300 | 3 | 6 | 15 |
| 151 | 460 | 6 | 420 | 6 | 300 | 6 | 12 | 6 |
| 152 | 460 | 6 | 420 | 6 | 300 | 3 | 6 | 10 |
| 153 | 460 | 6 | 420 | 6 | 300 | 3 | 6 | 15 |
| 154 | 460 | 6 | 420 | 6 | 300 | 6 | 12 | 6 |

TABLE 2-5

| No Comparative Example | First aging treatment | | | | | | | |
|---|---|---|---|---|---|---|---|---|
| | First stage tempreture (° C.) | First stage → Second stage cooling rate (° C./min) | Second stage tempreture (° C.) | Second stage →Third stage cooling rate (° C./min) | Third stage tempreture (° C.) | First stage time (hr) | Second stage time (hr) | Third stage time (hr) |
| 1 | — | — | 420 | 6 | 300 | — | 6 | 15 |
| 2 | | | | 6 | | | 6 | 10 |
| 3 | | | | 6 | | | 6 | 6 |
| 4 | 460 | 6 | — | 6 | 300 | 3 | — | 15 |
| 5 | | 6 | | 6 | | 3 | | 10 |
| 6 | | 6 | | 6 | | 3 | | 6 |
| 7 | 460 | 6 | — | — | — | 3 | — | — |
| 8 | | 6 | | | | 6 | | |
| 9 | | 6 | | | | 12 | | |
| 10 | — | — | — | — | 300 | — | — | 15 |
| 11 | | | | | | | | 10 |
| 12 | | | | | | | | 6 |
| 13 | 460 | 6 | 420 | — | — | 3 | 6 | — |
| 14 | 400 | 6 | 360 | 6 | 330 | 6 | 12 | 0 |
| 15 | | 6 | | 6 | | 6 | 12 | 1 |
| 16 | | 6 | | 6 | | 6 | 12 | 3 |
| 17 | | 6 | | 6 | | 12 | 6 | 0 |
| 18 | | 6 | | 6 | | 12 | 6 | 1 |
| 19 | | 6 | | 6 | | 12 | 6 | 3 |
| 20 | | 6 | | 6 | | 12 | 12 | 0 |
| 21 | | 6 | | 6 | | 12 | 12 | 1 |
| 22 | | 6 | | 6 | | 12 | 12 | 3 |
| 23 | 460 | 6 | 420 | 6 | 270 | 3 | 6 | 0 |
| 24 | | 6 | | 6 | | 3 | 6 | 1 |
| 25 | | 6 | | 6 | | 3 | 6 | 3 |
| 26 | | 6 | | 6 | | 6 | 6 | 0 |
| 27 | | 6 | | 6 | | 6 | 6 | 1 |
| 28 | | 6 | | 6 | | 6 | 6 | 3 |
| 29 | | 6 | | 6 | | 6 | 12 | 0 |
| 30 | | 6 | | 6 | | 6 | 12 | 1 |
| 31 | | 6 | | 6 | | 6 | 12 | 3 |
| 32 | 460 | 6 | 420 | 6 | 300 | 3 | 6 | 0 |
| 33 | | 6 | | 6 | | 3 | 6 | 1 |
| 34 | | 6 | | 6 | | 3 | 6 | 3 |
| 35 | | 6 | | 6 | | 6 | 6 | 0 |
| 36 | | 6 | | 6 | | 6 | 6 | 1 |
| 37 | | 6 | | 6 | | 6 | 6 | 3 |
| 38 | | 6 | | 6 | | 6 | 12 | 0 |
| 39 | | 6 | | 6 | | 6 | 12 | 1 |
| 40 | | 6 | | 6 | | 6 | 12 | 3 |
| 41 | 460 | 6 | 420 | 6 | 330 | 3 | 6 | 0 |
| 42 | | 6 | | 6 | | 3 | 6 | 1 |
| 43 | | 6 | | 6 | | 3 | 6 | 3 |
| 44 | | 6 | | 6 | | 6 | 6 | 0 |
| 45 | | 6 | | 6 | | 6 | 6 | 1 |
| 46 | | 6 | | 6 | | 6 | 6 | 3 |
| 47 | | 6 | | 6 | | 6 | 12 | 0 |
| 48 | | 6 | | 6 | | 6 | 12 | 1 |
| 49 | | 6 | | 6 | | 6 | 12 | 3 |

TABLE 2-6

| No Comparative Example | First aging treatment | | | | | | | |
|---|---|---|---|---|---|---|---|---|
| | First stage tempreture (° C.) | First stage → Second stage cooling rate (° C./min) | Second stage tempreture (° C.) | Second stage →Third stage cooling rate (° C./min) | Third stage tempreture (° C.) | First stage time (hr) | Second stage time (hr) | Third stage time (hr) |
| 50 | 500 | 6 | 450 | 6 | 270 | 1 | 3 | 0 |
| 51 | | 6 | | 6 | | 1 | 3 | 1 |
| 52 | | 6 | | 6 | | 1 | 3 | 3 |
| 53 | | 6 | | 6 | | 1 | 6 | 0 |
| 54 | | 6 | | 6 | | 1 | 6 | 1 |
| 55 | | 6 | | 6 | | 1 | 6 | 3 |
| 56 | | 6 | | 6 | | 3 | 3 | 0 |
| 57 | | 6 | | 6 | | 3 | 3 | 1 |
| 58 | | 6 | | 6 | | 3 | 3 | 3 |
| 59 | — | — | 420 | 6 | 300 | — | 6 | 15 |
| 60 | | — | | 6 | | — | 6 | 10 |

TABLE 2-6-continued

| No Comparative Example | First aging treatment | | | | | | | |
|---|---|---|---|---|---|---|---|---|
| | First stage tempreture (° C.) | First stage → Second stage cooling rate (° C./min) | Second stage tempreture (° C.) | Second stage →Third stage cooling rate (° C./min) | Third stage tempreture (° C.) | First stage time (hr) | Second stage time (hr) | Third stage time (hr) |
| 61 | | — | | 6 | | — | 6 | 6 |
| 62 | 460 | 6 | — | 6 | 300 | 3 | — | 15 |
| 63 | | 6 | | 6 | | 3 | — | 10 |
| 64 | | 6 | | 6 | | 3 | — | 6 |
| 65 | 460 | 6 | — | — | — | 3 | — | — |
| 66 | | 6 | | — | | 6 | | |
| 67 | | 6 | | — | | 12 | | |
| 68 | — | — | — | — | 300 | — | — | 15 |
| 69 | | — | | — | | | | 10 |
| 70 | | — | | — | | | | 6 |
| 71 | 460 | 6 | 420 | — | — | 3 | 6 | — |
| 72 | 400 | 6 | 360 | 6 | 330 | 6 | 12 | 0 |
| 73 | | 6 | | 6 | | 6 | 12 | 1 |
| 74 | | 6 | | 6 | | 6 | 12 | 3 |
| 75 | | 6 | | 6 | | 12 | 6 | 0 |
| 76 | | 6 | | 6 | | 12 | 6 | 1 |
| 77 | | 6 | | 6 | | 12 | 6 | 3 |
| 78 | | 6 | | 6 | | 12 | 12 | 0 |
| 79 | | 6 | | 6 | | 12 | 12 | 1 |
| 80 | | 6 | | 6 | | 12 | 12 | 3 |
| 81 | 460 | 6 | 420 | 6 | 270 | 3 | 6 | 0 |
| 82 | | 6 | | 6 | | 3 | 6 | 1 |
| 83 | | 6 | | 6 | | 3 | 6 | 3 |
| 84 | | 6 | | 6 | | 6 | 6 | 0 |
| 85 | | 6 | | 6 | | 6 | 6 | 1 |
| 86 | | 6 | | 6 | | 6 | 6 | 3 |
| 87 | | 6 | | 6 | | 6 | 12 | 0 |
| 88 | | 6 | | 6 | | 6 | 12 | 1 |
| 89 | | 6 | | 6 | | 6 | 12 | 3 |
| 90 | 460 | 6 | 420 | 6 | 300 | 3 | 6 | 0 |
| 91 | | 6 | | 6 | | 3 | 6 | 1 |
| 92 | | 6 | | 6 | | 3 | 6 | 3 |
| 93 | | 6 | | 6 | | 6 | 6 | 0 |
| 94 | | 6 | | 6 | | 6 | 6 | 1 |
| 95 | | 6 | | 6 | | 6 | 6 | 3 |
| 96 | | 6 | | 6 | | 6 | 12 | 0 |
| 97 | | 6 | | 6 | | 6 | 12 | 1 |
| 98 | | 6 | | 6 | | 6 | 12 | 3 |

TABLE 2-7

| No Comparative Example | First aging treatment | | | | | | | |
|---|---|---|---|---|---|---|---|---|
| | First stage tempreture (° C.) | First stage → Second stage cooling rate (° C./min) | Second stage tempreture (° C.) | Second stage →Third stage cooling rate (° C./min) | Third stage tempreture (° C.) | First stage time (hr) | Second stage time (hr) | Third stage time (hr) |
| 99 | 460 | 6 | 420 | 6 | 330 | 3 | 6 | 0 |
| 100 | | 6 | | 6 | | 3 | 6 | 1 |
| 101 | | 6 | | 6 | | 3 | 6 | 3 |
| 102 | | 6 | | 6 | | 6 | 6 | 0 |
| 103 | | 6 | | 6 | | 6 | 6 | 1 |
| 104 | | 6 | | 6 | | 6 | 6 | 3 |
| 105 | | 6 | | 6 | | 6 | 12 | 0 |
| 106 | | 6 | | 6 | | 6 | 12 | 1 |
| 107 | | 6 | | 6 | | 6 | 12 | 3 |
| 108 | 500 | 6 | 450 | 6 | 270 | 1 | 3 | 0 |
| 109 | | 6 | | 6 | | 1 | 3 | 1 |
| 110 | | 6 | | 6 | | 1 | 3 | 3 |
| 111 | | 6 | | 6 | | 1 | 6 | 0 |
| 112 | | 6 | | 6 | | 1 | 6 | 1 |
| 113 | | 6 | | 6 | | 1 | 6 | 3 |
| 114 | | 6 | | 6 | | 3 | 3 | 0 |
| 115 | | 6 | | 6 | | 3 | 3 | 1 |
| 116 | | 6 | | 6 | | 3 | 3 | 3 |
| 117 | 460 | 6 | 420 | 6 | 200 | 3 | 6 | 6 |
| 118 | | 6 | | 6 | | | | 10 |
| 119 | | 6 | | 6 | | | | 15 |

TABLE 2-7-continued

| No Comparative Example | First aging treatment | | | | | | | |
|---|---|---|---|---|---|---|---|---|
| | First stage tempreture (° C.) | First stage → Second stage cooling rate (° C./min) | Second stage tempreture (° C.) | Second stage →Third stage cooling rate (° C./min) | Third stage tempreture (° C.) | First stage time (hr) | Second stage time (hr) | Third stage time (hr) |
| 120 | 460 | 6 | 420 | 6 | 400 | 3 | 6 | 6 |
| 121 | | 6 | | 6 | | | | 10 |
| 122 | | 6 | | 6 | | | | 15 |
| 123 | 460 | 6 | 420 | 6 | 300 | 3 | 6 | 40 |
| 124 | | 6 | | 6 | | | | 60 |
| 125 | | 6 | | 6 | | | | 80 |
| 126 | 460 | 6 | 420 | 6 | 300 | 3 | 6 | 0 |
| 127 | | 6 | | 6 | | 3 | 6 | 1 |
| 128 | | 6 | | 6 | | 3 | 6 | 3 |
| 129 | 460 | 6 | 420 | — | — | 3 | 6 | — |
| 130 | 460 | 6 | 420 | 6 | 300 | 3 | 6 | 0 |
| 131 | | 6 | | 6 | | 3 | 6 | 1 |
| 132 | | 6 | | 6 | | 3 | 6 | 3 |
| 133 | 460 | 6 | 420 | — | — | 3 | 6 | — |
| 134 | 460 | 6 | 420 | 6 | 300 | 3 | 6 | 0 |
| 135 | | 6 | | 6 | | 3 | 6 | 1 |
| 136 | | 6 | | 6 | | 3 | 6 | 3 |
| 137 | 460 | 6 | 420 | — | — | 3 | 6 | — |
| 138 | 460 | 6 | 420 | 6 | 300 | 3 | 6 | 0 |
| 139 | | 6 | | 6 | | 3 | 6 | 1 |
| 140 | | 6 | | 6 | | 3 | 6 | 3 |
| 141 | 460 | 6 | 420 | — | — | 3 | 6 | — |
| 142 | 460 | 6 | 420 | 6 | 300 | 3 | 6 | 0 |
| 143 | | 6 | | 6 | | 3 | 6 | 1 |
| 144 | | 6 | | 6 | | 3 | 6 | 3 |
| 145 | 460 | 6 | 420 | — | — | 3 | 6 | — |
| 146 | 460 | 6 | 420 | 6 | 300 | 3 | 6 | 0 |
| 147 | | 6 | | 6 | | 3 | 6 | 1 |
| 148 | | 6 | | 6 | | 3 | 6 | 3 |
| 149 | 460 | 6 | 420 | — | — | 3 | 6 | — |

TABLE 2-8

| No Comparative Example | First aging treatment | | | | | | | |
|---|---|---|---|---|---|---|---|---|
| | First stage tempreture (° C.) | First stage → Second stage cooling rate (° C./min) | Second stage tempreture (° C.) | Second stage →Third stage cooling rate (° C./min) | Third stage tempreture (° C.) | First stage time (hr) | Second stage time (hr) | Third stage time (hr) |
| 150 | 460 | 6 | 420 | 6 | 300 | 3 | 6 | 0 |
| 151 | | 6 | | 6 | | 3 | 6 | 1 |
| 152 | | 6 | | 6 | | 3 | 6 | 3 |
| 153 | 460 | 6 | 420 | — | — | 3 | 6 | — |
| 154 | 460 | 6 | 420 | 6 | 300 | 3 | 6 | 0 |
| 155 | | 6 | | 6 | | 3 | 6 | 1 |
| 156 | | 6 | | 6 | | 3 | 6 | 3 |
| 157 | 460 | 6 | 420 | — | — | 3 | 6 | — |
| 158 | 460 | 6 | 420 | 6 | 300 | 3 | 6 | 0 |
| 159 | | 6 | | 6 | | 3 | 6 | 1 |
| 160 | | 6 | | 6 | | 3 | 6 | 3 |
| 161 | 460 | 6 | 420 | — | — | 3 | 6 | — |
| 162 | 460 | 6 | 420 | 6 | 300 | 3 | 6 | 0 |
| 163 | | 6 | | 6 | | 3 | 6 | 1 |
| 164 | | 6 | | 6 | | 3 | 6 | 3 |
| 165 | 460 | 6 | 420 | — | — | 3 | 6 | — |
| 166 | 460 | 6 | 420 | 6 | 300 | 3 | 6 | 0 |
| 167 | | 6 | | 6 | | 3 | 6 | 1 |
| 168 | | 6 | | 6 | | 3 | 6 | 3 |
| 169 | 460 | 6 | 420 | — | — | 3 | 6 | — |
| 170 | 460 | 6 | 420 | 6 | 300 | 3 | 6 | 0 |
| 171 | | 6 | | 6 | | 3 | 6 | 1 |
| 172 | | 6 | | 6 | | 3 | 6 | 3 |
| 173 | 460 | 6 | 420 | — | — | 3 | 6 | — |
| 174 | 460 | 6 | — | — | — | 3 | — | — |
| 175 | 460 | 6 | — | — | — | 3 | — | — |
| 176 | 460 | 6 | 420 | — | — | 3 | 6 | — |
| 177 | 460 | 6 | 420 | — | — | 3 | 6 | — |
| 178 | 460 | 6 | — | — | — | 3 | — | — |

TABLE 2-8-continued

| No Comparative Example | First aging treatment | | | | | | | |
|---|---|---|---|---|---|---|---|---|
| | First stage tempreture (° C.) | First stage → Second stage cooling rate (° C./min) | Second stage tempreture (° C.) | Second stage →Third stage cooling rate (° C./min) | Third stage tempreture (° C.) | First stage time (hr) | Second stage time (hr) | Third stage time (hr) |
| 179 | 460 | 6 | — | — | — | 3 | — | — |
| 180 | 460 | 6 | 420 | — | — | 3 | 6 | — |
| 181 | 460 | 6 | 420 | — | — | 3 | 6 | — |
| 182 | 460 | 6 | — | — | — | 3 | — | — |
| 183 | 460 | 6 | — | — | — | 3 | — | — |
| 184 | 460 | 6 | 420 | — | — | 3 | 6 | — |
| 185 | 460 | 6 | 420 | — | — | 3 | 6 | — |
| 186 | 460 | 15 | 420 | 15 | 300 | 3 | 6 | 15 |
| 187 | 460 | 15 | 420 | 15 | 300 | 3 | 6 | 15 |
| 188 | 460 | 0.1 | 420 | 0.1 | 300 | 3 | 6 | 15 |
| 189 | 460 | 0.1 | 420 | 0.1 | 300 | 3 | 6 | 15 |
| 190 | 460 | 6 | 420 | 6 | 300 | 3 | 6 | 15 |
| 191 | 460 | 6 | 420 | 6 | 300 | 3 | 6 | 15 |

TABLE 3-1

| No Example | Second aging treatment or temper annealing | | | | |
|---|---|---|---|---|---|
| | First stage tempreture or annealing tempreture (° C.) | First stage → Second stage cooling rate (° C./min) | Second stage tempreture (° C.) | First stage time or annealing time (hr) | Second stage time (hr) |
| 1 | 300 | — | — | 0.02 | — |
| 2 | 300 | — | — | 0.02 | — |
| 3 | 300 | — | — | 0.02 | — |
| 4 | 300 | — | — | 0.02 | — |
| 5 | 300 | — | — | 0.02 | — |
| 6 | 300 | — | — | 0.02 | — |
| 7 | 300 | — | — | 0.02 | — |
| 8 | 300 | — | — | 0.02 | — |
| 9 | 300 | — | — | 0.02 | — |
| 10 | 300 | — | — | 0.02 | — |
| 11 | 300 | — | — | 0.02 | — |
| 12 | 300 | — | — | 0.02 | — |
| 13 | 300 | — | — | 0.02 | — |
| 14 | 300 | — | — | 0.02 | — |
| 15 | 300 | — | — | 0.02 | — |
| 16 | 300 | — | — | 0.02 | — |
| 17 | 300 | — | — | 0.02 | — |
| 18 | 300 | — | — | 0.02 | — |
| 19 | 300 | — | — | 0.02 | — |
| 20 | 300 | — | — | 0.02 | — |
| 21 | 300 | — | — | 0.02 | — |
| 22 | 300 | — | — | 0.02 | — |
| 23 | 300 | — | — | 0.02 | — |
| 24 | 300 | — | — | 0.02 | — |
| 25 | 300 | — | — | 0.02 | — |
| 26 | 300 | — | — | 0.02 | — |
| 27 | 300 | — | — | 0.02 | — |
| 28 | 300 | — | — | 0.02 | — |
| 29 | 300 | — | — | 0.02 | — |
| 30 | 300 | — | — | 0.02 | — |
| 31 | 300 | — | — | 0.02 | — |
| 32 | 300 | — | — | 0.02 | — |
| 33 | 300 | — | — | 0.02 | — |
| 34 | 300 | — | — | 0.02 | — |
| 35 | 300 | — | — | 0.02 | — |
| 36 | 300 | — | — | 0.02 | — |
| 37 | 300 | — | — | 0.02 | — |
| 38 | 300 | — | — | 0.02 | — |
| 39 | 300 | — | — | 0.02 | — |
| 40 | 300 | — | — | 0.02 | — |
| 41 | 300 | — | — | 0.02 | — |
| 42 | 300 | — | — | 0.02 | — |
| 43 | 300 | — | — | 0.02 | — |

TABLE 3-1-continued

| No Example | Second aging treatment or temper annealing | | | | |
|---|---|---|---|---|---|
| | First stage tempreture or annealing tempreture (° C.) | First stage → Second stage cooling rate (° C./min) | Second stage tempreture (° C.) | First stage time or annealing time (hr) | Second stage time (hr) |
| 44 | 300 | — | — | 0.02 | — |
| 45 | 300 | — | — | 0.02 | — |

TABLE 3-2

| No Example | Second aging treatment or temper annealing | | | | |
|---|---|---|---|---|---|
| | First stage tempreture or annealing tempreture (° C.) | First stage → Second stage cooling rate (° C./min) | Second stage tempreture (° C.) | First stage time or annealing time (hr) | Second stage time (hr) |
| 46 | 300 | — | — | 0.02 | — |
| 47 | 300 | — | — | 0.02 | — |
| 48 | 300 | — | — | 0.02 | — |
| 49 | 300 | — | — | 0.02 | — |
| 50 | 300 | — | — | 0.02 | — |
| 51 | 300 | — | — | 0.02 | — |
| 52 | 300 | — | — | 0.02 | — |
| 53 | 300 | — | — | 0.02 | — |
| 54 | 300 | — | — | 0.02 | — |
| 55 | 300 | — | — | 0.02 | — |
| 56 | 300 | — | — | 0.02 | — |
| 57 | 300 | — | — | 0.02 | — |
| 58 | 300 | — | — | 0.02 | — |
| 59 | 300 | — | — | 0.02 | — |
| 60 | 300 | — | — | 0.02 | — |
| 61 | 300 | — | — | 0.02 | — |
| 62 | 300 | — | — | 0.02 | — |
| 63 | 300 | — | — | 0.02 | — |
| 64 | 300 | — | — | 0.02 | — |
| 65 | 300 | — | — | 0.02 | — |
| 66 | 300 | — | — | 0.02 | — |
| 67 | 300 | — | — | 0.02 | — |
| 68 | 300 | — | — | 0.02 | — |
| 69 | 300 | — | — | 0.02 | — |
| 70 | 300 | — | — | 0.02 | — |
| 71 | 300 | — | — | 0.02 | — |
| 72 | 300 | — | — | 0.02 | — |
| 73 | 300 | — | — | 0.02 | — |
| 74 | 300 | — | — | 0.02 | — |

TABLE 3-2-continued

| No Example | Second aging treatment or temper annealing: First stage tempreture or annealing tempreture (° C.) | First stage → Second stage cooling rate (° C./min) | Second stage tempreture (° C.) | First stage time or annealing time (hr) | Second stage time (hr) |
|---|---|---|---|---|---|
| 75 | 300 | — | — | 0.02 | — |
| 76 | 300 | — | — | 0.02 | — |
| 77 | 300 | — | — | 0.02 | — |
| 78 | 300 | — | — | 0.02 | — |
| 79 | 300 | — | — | 0.02 | — |
| 80 | 300 | — | — | 0.02 | — |
| 81 | 300 | — | — | 0.02 | — |
| 82 | 300 | — | — | 0.02 | — |
| 83 | 300 | — | — | 0.02 | — |
| 84 | 300 | — | — | 0.02 | — |
| 85 | 300 | — | — | 0.02 | — |
| 86 | 300 | — | — | 0.02 | — |
| 87 | 300 | — | — | 0.02 | — |
| 88 | 300 | — | — | 0.02 | — |
| 89 | 300 | — | — | 0.02 | — |
| 90 | 300 | — | — | 0.02 | — |

TABLE 3-3

| No Example | Second aging treatment or temper annealing: First stage tempreture or annealing tempreture (° C.) | First stage → Second stage cooling rate (° C./min) | Second stage tempreture (° C.) | First stage time or annealing time (hr) | Second stage time (hr) |
|---|---|---|---|---|---|
| 91 | 300 | — | — | 0.02 | — |
| 92 | 300 | — | — | 0.02 | — |
| 93 | 300 | — | — | 0.02 | — |
| 94 | 300 | — | — | 0.02 | — |
| 95 | 300 | — | — | 0.02 | — |
| 96 | 300 | — | — | 0.02 | — |
| 97 | 300 | — | — | 0.02 | — |
| 98 | 300 | — | — | 0.02 | — |
| 99 | 300 | — | — | 0.02 | — |
| 100 | 300 | — | — | 0.02 | — |
| 101 | 300 | — | — | 0.02 | — |
| 102 | 300 | — | — | 0.02 | — |
| 103 | 300 | — | — | 0.02 | — |
| 104 | 300 | — | — | 0.02 | — |
| 105 | 300 | — | — | 0.02 | — |
| 106 | 300 | — | — | 0.02 | — |
| 107 | 300 | — | — | 0.02 | — |
| 108 | 300 | — | — | 0.02 | — |
| 109 | 300 | — | — | 0.02 | — |
| 110 | 300 | — | — | 0.02 | — |
| 111 | 300 | — | — | 0.02 | — |
| 112 | 300 | — | — | 0.02 | — |
| 113 | 300 | — | — | 0.02 | — |
| 114 | 300 | — | — | 0.02 | — |
| 115 | 300 | — | — | 0.02 | — |
| 116 | 300 | — | — | 0.02 | — |
| 117 | 300 | — | — | 0.02 | — |
| 118 | 300 | — | — | 0.02 | — |
| 119 | 300 | — | — | 0.02 | — |
| 120 | 300 | — | — | 0.02 | — |
| 121 | 300 | — | — | 0.02 | — |
| 122 | 300 | — | — | 0.02 | — |
| 123 | 300 | — | — | 0.02 | — |
| 124 | 300 | — | — | 0.02 | — |
| 125 | 300 | — | — | 0.02 | — |
| 126 | 300 | — | — | 0.02 | — |
| 127 | 300 | — | — | 0.02 | — |
| 128 | 300 | — | — | 0.02 | — |
| 129 | 300 | — | — | 0.02 | — |

TABLE 3-4

| No Example | Second aging treatment or temper annealing: First stage tempreture or annealing tempreture (° C.) | First stage → Second stage cooling rate (° C./min) | Second stage tempreture (° C.) | First stage time or annealing time (hr) | Second stage time (hr) |
|---|---|---|---|---|---|
| 130 | 300 | — | — | 0.02 | — |
| 131 | 300 | — | — | 0.02 | — |
| 132 | 300 | — | — | 0.02 | — |
| 133 | 300 | — | — | 0.02 | — |
| 134 | 300 | — | — | 0.02 | — |
| 135 | — | — | — | — | — |
| 136 | — | — | — | — | — |
| 137 | — | — | — | — | — |
| 138 | — | — | — | — | — |
| 139 | — | — | — | — | — |
| 140 | — | — | — | — | — |
| 141 | — | — | — | — | — |
| 142 | — | — | — | — | — |
| 143 | — | — | — | — | — |
| 144 | — | — | — | — | — |
| 145 | — | — | — | — | — |
| 146 | — | — | — | — | — |
| 147 | — | — | — | — | — |
| 148 | — | — | — | — | — |
| 149 | — | — | — | — | — |
| 150 | — | — | — | — | — |
| 151 | — | — | — | — | — |
| 152 | — | — | — | — | — |
| 153 | — | — | — | — | — |
| 154 | — | — | — | — | — |

TABLE 3-5

| No Comparative Example | Second aging treatment or temper annealing: First stage tempreture or annealing tempreture (° C.) | First stage → Second stage cooling rate (° C./min) | Second stage tempreture (° C.) | First stage time or annealing time (hr) | Second stage time (hr) |
|---|---|---|---|---|---|
| 1 | — | — | — | — | — |
| 2 | — | — | — | — | — |
| 3 | — | — | — | — | — |
| 4 | — | — | — | — | — |
| 5 | — | — | — | — | — |
| 6 | — | — | — | — | — |
| 7 | — | — | — | — | — |
| 8 | — | — | — | — | — |
| 9 | — | — | — | — | — |
| 10 | — | — | — | — | — |
| 11 | — | — | — | — | — |
| 12 | — | — | — | — | — |
| 13 | 300 | 6 | 260 | 3 | 6 |
| 14 | — | — | — | — | — |
| 15 | — | — | — | — | — |
| 16 | — | — | — | — | — |
| 17 | — | — | — | — | — |
| 18 | — | — | — | — | — |
| 19 | — | — | — | — | — |
| 20 | — | — | — | — | — |
| 21 | — | — | — | — | — |
| 22 | — | — | — | — | — |
| 23 | — | — | — | — | — |
| 24 | — | — | — | — | — |
| 25 | — | — | — | — | — |
| 26 | — | — | — | — | — |
| 27 | — | — | — | — | — |
| 28 | — | — | — | — | — |
| 29 | — | — | — | — | — |
| 30 | — | — | — | — | — |
| 31 | — | — | — | — | — |

TABLE 3-5-continued

| No Comparative Example | Second aging treatment or temper annealing: First stage tempreture or annealing tempreture (° C.) | First stage → Second stage cooling rate (° C./min) | Second stage tempreture (° C.) | First stage time or annealing time (hr) | Second stage time (hr) |
|---|---|---|---|---|---|
| 32 | — | — | — | — | — |
| 33 | — | — | — | — | — |
| 34 | — | — | — | — | — |
| 35 | — | — | — | — | — |
| 36 | — | — | — | — | — |
| 37 | — | — | — | — | — |
| 38 | — | — | — | — | — |
| 39 | — | — | — | — | — |
| 40 | — | — | — | — | — |
| 41 | — | — | — | — | — |
| 42 | — | — | — | — | — |
| 43 | — | — | — | — | — |
| 44 | — | — | — | — | — |
| 45 | — | — | — | — | — |
| 46 | — | — | — | — | — |
| 47 | — | — | — | — | — |
| 48 | — | — | — | — | — |
| 49 | — | — | — | — | — |

TABLE 3-6

| No Comparative Example | Second aging treatment or temper annealing: First stage tempreture or annealing tempreture (° C.) | First stage → Second stage cooling rate (° C./min) | Second stage tempreture (° C.) | First stage time or annealing time (hr) | Second stage time (hr) |
|---|---|---|---|---|---|
| 50 | — | — | — | — | — |
| 51 | — | — | — | — | — |
| 52 | — | — | — | — | — |
| 53 | — | — | — | — | — |
| 54 | — | — | — | — | — |
| 55 | — | — | — | — | — |
| 56 | — | — | — | — | — |
| 57 | — | — | — | — | — |
| 58 | — | — | — | — | — |
| 59 | — | — | — | — | — |
| 60 | — | — | — | — | — |
| 61 | — | — | — | — | — |
| 62 | — | — | — | — | — |
| 63 | — | — | — | — | — |
| 64 | — | — | — | — | — |
| 65 | — | — | — | — | — |
| 66 | — | — | — | — | — |
| 67 | — | — | — | — | — |
| 68 | — | — | — | — | — |
| 69 | — | — | — | — | — |
| 70 | — | — | — | — | — |
| 71 | 300 | 6 | 260 | 3 | 6 |
| 72 | — | — | — | — | — |
| 73 | — | — | — | — | — |
| 74 | — | — | — | — | — |
| 75 | — | — | — | — | — |
| 76 | — | — | — | — | — |
| 77 | — | — | — | — | — |
| 78 | — | — | — | — | — |
| 79 | — | — | — | — | — |
| 80 | — | — | — | — | — |
| 81 | — | — | — | — | — |
| 82 | — | — | — | — | — |
| 83 | — | — | — | — | — |
| 84 | — | — | — | — | — |
| 85 | — | — | — | — | — |
| 86 | — | — | — | — | — |
| 87 | — | — | — | — | — |

TABLE 3-6-continued

| No Comparative Example | Second aging treatment or temper annealing: First stage tempreture or annealing tempreture (° C.) | First stage → Second stage cooling rate (° C./min) | Second stage tempreture (° C.) | First stage time or annealing time (hr) | Second stage time (hr) |
|---|---|---|---|---|---|
| 88 | — | — | — | — | — |
| 89 | — | — | — | — | — |
| 90 | — | — | — | — | — |
| 91 | — | — | — | — | — |
| 92 | — | — | — | — | — |
| 93 | — | — | — | — | — |
| 94 | — | — | — | — | — |
| 95 | — | — | — | — | — |
| 96 | — | — | — | — | — |
| 97 | — | — | — | — | — |
| 98 | — | — | — | — | — |

TABLE 3-7

| No Comparative Example | Second aging treatment or temper annealing: First stage tempreture or annealing tempreture (° C.) | First stage → Second stage cooling rate (° C./min) | Second stage tempreture (° C.) | First stage time or annealing time (hr) | Second stage time (hr) |
|---|---|---|---|---|---|
| 99 | — | — | — | — | — |
| 100 | — | — | — | — | — |
| 101 | — | — | — | — | — |
| 102 | — | — | — | — | — |
| 103 | — | — | — | — | — |
| 104 | — | — | — | — | — |
| 105 | — | — | — | — | — |
| 106 | — | — | — | — | — |
| 107 | — | — | — | — | — |
| 108 | — | — | — | — | — |
| 109 | — | — | — | — | — |
| 110 | — | — | — | — | — |
| 111 | — | — | — | — | — |
| 112 | — | — | — | — | — |
| 113 | — | — | — | — | — |
| 114 | — | — | — | — | — |
| 115 | — | — | — | — | — |
| 116 | — | — | — | — | — |
| 117 | — | — | — | — | — |
| 118 | — | — | — | — | — |
| 119 | — | — | — | — | — |
| 120 | — | — | — | — | — |
| 121 | — | — | — | — | — |
| 122 | — | — | — | — | — |
| 123 | — | — | — | — | — |
| 124 | — | — | — | — | — |
| 125 | — | — | — | — | — |
| 126 | — | — | — | — | — |
| 127 | — | — | — | — | — |
| 128 | — | — | — | — | — |
| 129 | 300 | 6 | 260 | 3 | 6 |
| 130 | — | — | — | — | — |
| 131 | — | — | — | — | — |
| 132 | — | — | — | — | — |
| 133 | 300 | 6 | 260 | 3 | 6 |
| 134 | — | — | — | — | — |
| 135 | — | — | — | — | — |
| 136 | — | — | — | — | — |
| 137 | 300 | 6 | 260 | 3 | 6 |
| 138 | — | — | — | — | — |
| 139 | — | — | — | — | — |
| 140 | — | — | — | — | — |
| 141 | 300 | 6 | 260 | 3 | 6 |
| 142 | — | — | — | — | — |
| 143 | — | — | — | — | — |

TABLE 3-7-continued

| No Comparative Example | Second aging treatment or temper annealing: First stage tempreture or annealing tempreture (° C.) | First stage → Second stage cooling rate (° C./min) | Second stage tempreture (° C.) | First stage time or annealing time (hr) | Second stage time (hr) |
|---|---|---|---|---|---|
| 144 | — | — | — | — | — |
| 145 | 300 | 6 | 260 | 3 | 6 |
| 146 | — | — | — | — | — |
| 147 | — | — | — | — | — |
| 148 | — | — | — | — | — |
| 149 | 300 | 6 | 260 | 3 | 6 |

TABLE 3-8

| No Comparative Example | Second aging treatment or temper annealing: First stage tempreture or annealing tempreture (° C.) | First stage → Second stage cooling rate (° C./min) | Second stage tempreture (° C.) | First stage time or annealing time (hr) | Second stage time (hr) |
|---|---|---|---|---|---|
| 150 | — | — | — | — | — |
| 151 | — | — | — | — | — |
| 152 | — | — | — | — | — |
| 153 | 300 | 6 | 260 | 3 | 6 |
| 154 | — | — | — | — | — |
| 155 | — | — | — | — | — |
| 156 | — | — | — | — | — |
| 157 | 300 | 6 | 260 | 3 | 6 |
| 158 | — | — | — | — | — |
| 159 | — | — | — | — | — |
| 160 | — | — | — | — | — |
| 161 | 300 | 6 | 260 | 3 | 6 |
| 162 | — | — | — | — | — |
| 163 | — | — | — | — | — |
| 164 | — | — | — | — | — |
| 165 | 300 | 6 | 260 | 3 | 6 |
| 166 | — | — | — | — | — |
| 167 | — | — | — | — | — |
| 168 | — | — | — | — | — |
| 169 | 300 | 6 | 260 | 3 | 6 |
| 170 | — | — | — | — | — |
| 171 | — | — | — | — | — |
| 172 | — | — | — | — | — |
| 173 | 300 | 6 | 260 | 3 | 6 |
| 174 | — | — | — | — | — |
| 175 | — | — | — | — | — |
| 176 | 300 | 6 | 260 | 3 | 6 |
| 177 | 300 | 6 | 260 | 3 | 6 |
| 178 | — | — | — | — | — |
| 179 | — | — | — | — | — |
| 180 | 300 | 6 | 260 | 3 | 6 |
| 181 | 300 | 6 | 260 | 3 | 6 |
| 182 | — | — | — | — | — |
| 183 | — | — | — | — | — |
| 184 | 300 | 6 | 260 | 3 | 6 |
| 185 | 300 | 6 | 260 | 3 | 6 |
| 186 | | | — | — | — |

TABLE 3-8-continued

| No Comparative Example | Second aging treatment or temper annealing: First stage tempreture or annealing tempreture (° C.) | First stage → Second stage cooling rate (° C./min) | Second stage tempreture (° C.) | First stage time or annealing time (hr) | Second stage time (hr) |
|---|---|---|---|---|---|
| 187 | | | — | — | — |
| 188 | | | — | — | — |
| 189 | | | — | — | — |
| 190 | 300 | 6 | 260 | 3 | 6 |
| 191 | 300 | 6 | 260 | 3 | 6 |

For the various specimens obtained as such, the number density of the second phase particles and the alloy characteristics were measured in the following manner.

When second phase particles having a particle size of from 0.1 μm to 1 μm were observed, first, a material surface (rolled surface) was electrolytically polished to dissolve the matrix of Cu, and the second phase particles were left behind to be exposed. The electrolytic polishing liquid used was a mixture of phosphoric acid, sulfuric acid and pure water at an appropriate ratio. Second phase particles having a particle size of 0.1 μm to 1 μm that are dispersed in any arbitrary 10 sites were all observed and analyzed by using an FE-EPMA (field emission type EPMA: JXA-8500F manufactured by JEOL, Ltd.) and using an accelerating voltage of 5 kV to 10 kV, a sample current of $2\times10^{-8}$ A to $10^{-10}$ A, and analyzing crystals of LDE, TAP, PET and LIF, at a magnification ratio of 3000 times (observation field of vision: 30 μm×30 μm). The numbers of precipitates were counted, and the numbers per square millimeter ($mm^2$) was calculated.

With regard to strength, a tensile test in the direction parallel to rolling was carried out according to JIS Z2241, and 0.2% yield strength (YS: MPa) was measured.

Electrical conductivity (EC; % IACS) was determined by measuring the volume resistivity by a double bridge method according to JIS H0505.

"Peak height ratio of β angle 145° at α=20°" and "peak height ratio of angle 185° at α=75°" was determined by the measuring method mentioned above using the X-ray diffractometer named RINT-2500V produced by Rigaku Corporation.

Drooping curl was determined by the measuring method mentioned above.

The bendability was evaluated by 90 degree bending as W bend test of W bending test of Badway (direction of warped axis is identical with rolling direction) under the condition that the ratio of thickness and bending radius of a test piece becomes 3 using W-shaped die. Subsequently, the surface of bending portion was observed with an optical microscope, and when no crack was found, the test piece was recognized as non-defective (good), and when any crack was found, it was recognized as defective (bad).

The test results for various specimens are presented in Table 4.

TABLE 4-1

| No Example | YS (MPa) | EC (% IACS) | Drooping curl (mm) | Second phase particles × $10^5$/mm2 | peak height rate(1) α = 20° β = 145° | peak height rate(2) α = 75° β = 185° | bendability |
|---|---|---|---|---|---|---|---|
| 1 | 805 | 42 | 12 | 1.3 | 4.7 | 4.1 | good |
| 2 | 809 | 43 | 14 | 1.2 | 4.5 | 4.2 | good |
| 3 | 814 | 43 | 13 | 1.1 | 4.8 | 4 | good |

TABLE 4-1-continued

| No Example | YS (MPa) | EC (% IACS) | Drooping curl (mm) | Second phase particles × $10^5$/mm2 | peak height rate(1) α = 20° β = 145° | peak height rate(2) α = 75° β = 185° | bendability |
|---|---|---|---|---|---|---|---|
| 4 | 807 | 42 | 13 | 1.3 | 4.9 | 4.1 | good |
| 5 | 815 | 43 | 15 | 2 | 4.7 | 4.4 | good |
| 6 | 819 | 43 | 13 | 2 | 4.6 | 4.5 | good |
| 7 | 815 | 43 | 8 | 1.2 | 4.2 | 4.2 | good |
| 8 | 820 | 44 | 23 | 1.9 | 4.3 | 4.2 | good |
| 9 | 825 | 44 | 11 | 1.9 | 4.5 | 4 | good |
| 10 | 830 | 44 | 22 | 0.9 | 4.8 | 4.1 | good |
| 11 | 835 | 44 | 18 | 0.8 | 4.9 | 4.4 | good |
| 12 | 840 | 45 | 15 | 0.7 | 4.9 | 4.5 | good |
| 13 | 815 | 46 | 14 | 0.9 | 4.7 | 4.2 | good |
| 14 | 820 | 46 | 16 | 1.6 | 4.6 | 4.1 | good |
| 15 | 825 | 47 | 15 | 1.6 | 4.2 | 4.5 | good |
| 16 | 805 | 46 | 15 | 0.8 | 4.4 | 4.2 | good |
| 17 | 810 | 47 | 14 | 1.5 | 4.5 | 3.7 | good |
| 18 | 815 | 48 | 20 | 1.5 | 4.8 | 4 | good |
| 19 | 840 | 45 | 14 | 1.4 | 4.9 | 3.7 | good |
| 20 | 835 | 45 | 13 | 1.3 | 4.3 | 4.1 | good |
| 21 | 830 | 44 | 13 | 1.2 | 4.5 | 4.2 | good |
| 22 | 810 | 45 | 15 | 1.4 | 4.8 | 4 | good |
| 23 | 815 | 45 | 13 | 2.1 | 4.6 | 4.1 | good |
| 24 | 820 | 46 | 8 | 2.1 | 4.9 | 4.4 | good |
| 25 | 805 | 45 | 14 | 1.3 | 5.0 | 4.3 | good |
| 26 | 810 | 45 | 16 | 2 | 4.6 | 4.2 | good |
| 27 | 815 | 46 | 15 | 2 | 4.2 | 4.1 | good |
| 28 | 835 | 45 | 15 | 1.5 | 4.4 | 4.1 | good |
| 29 | 825 | 46 | 14 | 1.4 | 4.5 | 4.3 | good |
| 30 | 820 | 46 | 12 | 1.3 | 5.2 | 4.5 | good |
| 31 | 825 | 45 | 14 | 1.5 | 4.2 | 4.1 | good |
| 32 | 815 | 46 | 13 | 2.2 | 4.4 | 4.2 | good |
| 33 | 810 | 46 | 13 | 2.2 | 4.5 | 4 | good |
| 34 | 815 | 46 | 15 | 1.4 | 4.8 | 4.1 | good |
| 35 | 810 | 47 | 13 | 2.1 | 4.9 | 4.2 | good |
| 36 | 805 | 47 | 9 | 2.1 | 4.3 | 4 | good |
| 37 | 810 | 43 | 18 | 1.2 | 4.5 | 4.1 | good |
| 38 | 820 | 44 | 10 | 1.1 | 4.8 | 4.4 | good |
| 39 | 825 | 44 | 14 | 1 | 4.9 | 4.5 | good |
| 40 | 805 | 45 | 15 | 1.2 | 5.0 | 4.2 | good |
| 41 | 810 | 46 | 12 | 1.9 | 4.6 | 4.2 | good |
| 42 | 815 | 46 | 13 | 1.9 | 4.2 | 4 | good |
| 43 | 805 | 45 | 18 | 1.1 | 4.2 | 4.1 | good |
| 44 | 810 | 46 | 19 | 1.8 | 4.4 | 4.4 | good |
| 45 | 815 | 46 | 21 | 1.8 | 4.5 | 4.2 | good |

TABLE 4-2

| No Example | YS (MPa) | EC (% IACS) | Drooping curl (mm) | Second phase particles × $10^5$/mm2 | peak height rate(1) α = 20° β = 145° | peak height rate(2) α = 75° β = 185° | bendability |
|---|---|---|---|---|---|---|---|
| 46 | 820 | 43 | 18 | 1.8 | 4.3 | 4 | good |
| 47 | 823 | 44 | 15 | 1.7 | 5.0 | 4.2 | good |
| 48 | 828 | 44 | 14 | 1.6 | 4.6 | 3.7 | good |
| 49 | 820 | 43 | 16 | 1.8 | 4.2 | 4.2 | good |
| 50 | 830 | 44 | 15 | 2.5 | 4.4 | 4.2 | good |
| 51 | 834 | 44 | 15 | 2.5 | 4.5 | 4 | good |
| 52 | 830 | 44 | 14 | 1.7 | 4.8 | 4.1 | good |
| 53 | 835 | 45 | 20 | 2.4 | 4.9 | 4.3 | good |
| 54 | 840 | 45 | 14 | 2.4 | 4.3 | 4 | good |
| 55 | 840 | 45 | 13 | 1.4 | 5.0 | 4.2 | good |
| 56 | 845 | 45 | 13 | 1.3 | 4.6 | 4.1 | good |
| 57 | 850 | 46 | 15 | 1.2 | 4.6 | 4.5 | good |
| 58 | 825 | 47 | 13 | 1.4 | 4.2 | 4.2 | good |
| 59 | 830 | 47 | 15 | 2.1 | 4.4 | 3.7 | good |
| 60 | 835 | 48 | 15 | 2.1 | 4.5 | 4 | good |
| 61 | 820 | 47 | 14 | 1.3 | 5.2 | 3.7 | good |
| 62 | 825 | 48 | 12 | 2 | 5.1 | 3.9 | good |
| 63 | 835 | 49 | 14 | 2 | 5.0 | 4 | good |
| 64 | 850 | 46 | 13 | 1.9 | 5.0 | 3.8 | good |

TABLE 4-2-continued

| No Example | YS (MPa) | EC (% IACS) | Drooping curl (mm) | Second phase particles × $10^5$/mm2 | peak height rate(1) α = 20° β = 145° | peak height rate(2) α = 75° β = 185° | bendability |
|---|---|---|---|---|---|---|---|
| 65 | 845 | 46 | 18 | 1.8 | 4.2 | 3.7 | good |
| 66 | 840 | 45 | 15 | 1.7 | 4.4 | 4.2 | good |
| 67 | 830 | 46 | 9 | 1.9 | 4.5 | 4.2 | good |
| 68 | 835 | 46 | 18 | 2.6 | 4.7 | 4.1 | good |
| 69 | 840 | 47 | 10 | 2.6 | 4.8 | 4 | good |
| 70 | 820 | 46 | 14 | 1.8 | 4.3 | 4.2 | good |
| 71 | 825 | 46 | 15 | 2.5 | 4.5 | 3.7 | good |
| 72 | 830 | 47 | 12 | 2.5 | 4.2 | 4.2 | good |
| 73 | 850 | 46 | 15 | 2 | 4.4 | 4.2 | good |
| 74 | 840 | 47 | 15 | 1.9 | 4.5 | 4 | good |
| 75 | 835 | 47 | 14 | 1.8 | 5.2 | 4.1 | good |
| 76 | 840 | 46 | 20 | 2 | 4.2 | 4.4 | good |
| 77 | 835 | 47 | 14 | 2.7 | 4.0 | 4.5 | good |
| 78 | 830 | 47 | 13 | 2.7 | 4.2 | 4.2 | good |
| 79 | 830 | 47 | 13 | 1.9 | 4.4 | 4.2 | good |
| 80 | 823 | 48 | 15 | 2.6 | 4.5 | 4.1 | good |
| 81 | 820 | 48 | 13 | 2.6 | 5.0 | 3.9 | good |
| 82 | 825 | 44 | 8 | 1.7 | 4.6 | 3.8 | good |
| 83 | 835 | 45 | 14 | 1.6 | 4.2 | 3.7 | good |
| 84 | 840 | 45 | 16 | 1.5 | 4.4 | 3.9 | good |
| 85 | 820 | 46 | 15 | 1.7 | 4.5 | 4.1 | good |
| 86 | 823 | 47 | 15 | 2.4 | 4.0 | 4.2 | good |
| 87 | 828 | 47 | 14 | 2.4 | 4.2 | 4 | good |
| 88 | 820 | 46 | 12 | 1.6 | 4.4 | 4.3 | good |
| 89 | 823 | 47 | 15 | 2.3 | 4.5 | 4.6 | good |
| 90 | 830 | 47 | 13 | 2.3 | 5.0 | 4 | good |

TABLE 4-3

| No Example | YS (MPa) | EC (% IACS) | Drooping curl (mm) | Second phase particles × $10^5$/mm2 | peak height rate(1) α = 20° β = 145° | peak height rate(2) α = 75° β = 185° | bendability |
|---|---|---|---|---|---|---|---|
| 91 | 697 | 51 | 8 | 0.1 | 4.4 | 4.2 | good |
| 92 | 702 | 52 | 10 | 0.2 | 4.5 | 4.2 | good |
| 93 | 710 | 52 | 11 | 0.2 | 4.8 | 4 | good |
| 94 | 909 | 39 | 21 | 2.5 | 4.9 | 4.1 | good |
| 95 | 915 | 40 | 24 | 2.5 | 4.3 | 4.3 | good |
| 96 | 920 | 40 | 31 | 2.8 | 5.0 | 4 | good |
| 97 | 707 | 52 | 10 | 0.2 | 4.6 | 4.2 | good |
| 98 | 712 | 53 | 10 | 0.3 | 4.6 | 4.1 | good |
| 99 | 720 | 53 | 11 | 0.3 | 4.2 | 4.5 | good |
| 100 | 919 | 39 | 20 | 2.7 | 4.4 | 4.2 | good |
| 101 | 925 | 40 | 25 | 2.8 | 4.5 | 4 | good |
| 102 | 930 | 40 | 30 | 2.9 | 5.2 | 4.2 | good |
| 103 | 840 | 41 | 14 | 1.6 | 4.2 | 3.7 | good |
| 104 | 845 | 42 | 16 | 1.6 | 4.4 | 4.1 | good |
| 105 | 850 | 43 | 15 | 1.7 | 4.5 | 4.2 | good |
| 106 | 840 | 41 | 15 | 1.4 | 4.8 | 4 | good |
| 107 | 845 | 42 | 14 | 1.5 | 5.0 | 4.1 | good |
| 108 | 850 | 42 | 18 | 1.7 | 4.6 | 3.9 | good |
| 109 | 825 | 43 | 15 | 1.7 | 4.2 | 4 | good |
| 110 | 830 | 43 | 12 | 1.8 | 4.4 | 4.2 | good |
| 111 | 840 | 44 | 15 | 1.9 | 4.4 | 4 | good |
| 112 | 855 | 42 | 16 | 1.5 | 4.5 | 4.1 | good |
| 113 | 860 | 42 | 15 | 1.6 | 5.2 | 4.4 | good |
| 114 | 865 | 43 | 15 | 1.6 | 5.1 | 4.2 | good |
| 115 | 845 | 44 | 14 | 1.9 | 5.0 | 4.2 | good |
| 116 | 850 | 44 | 12 | 1.8 | 4.5 | 4.1 | good |
| 117 | 860 | 45 | 15 | 1.7 | 4.8 | 4 | good |
| 118 | 835 | 42 | 15 | 1.6 | 4.9 | 3.5 | good |
| 119 | 840 | 43 | 12 | 1.8 | 4.8 | 3.6 | good |
| 120 | 850 | 44 | 13 | 1.9 | 5.0 | 4.2 | good |
| 121 | 840 | 44 | 21 | 1.9 | 4.6 | 4.2 | good |
| 122 | 845 | 44 | 19 | 1.9 | 4.2 | 3.9 | good |
| 123 | 850 | 45 | 18 | 2 | 4.8 | 4 | good |
| 124 | 865 | 43 | 13 | 1.7 | 4.9 | 4.3 | good |
| 125 | 870 | 43 | 14 | 1.8 | 4.7 | 3.8 | good |

TABLE 4-3-continued

| No Example | YS (MPa) | EC (% IACS) | Drooping curl (mm) | Second phase particles × $10^5$/mm2 | peak height rate(1) α = 20° β = 145° | peak height rate(2) α = 75° β = 185° | bendability |
|---|---|---|---|---|---|---|---|
| 126 | 875 | 44 | 20 | 1.9 | 4.6 | 3.9 | good |
| 127 | 880 | 41 | 18 | 1.8 | 4.2 | 4.1 | good |
| 128 | 930 | 37 | 12 | 1.4 | 4.3 | 4.5 | good |
| 129 | 855 | 47 | 13 | 1.7 | 4.6 | 4.2 | good |

TABLE 4-4

| No Example | YS (MPa) | EC (% IACS) | Drooping curl (mm) | Second phase particles × $10^5$/mm2 | peak height rate(1) α = 20° β = 145° | peak height rate(2) α = 75° β = 185° | bendability |
|---|---|---|---|---|---|---|---|
| 130 | 870 | 42 | 20 | 3.5 | 4.8 | 4 | good |
| 131 | 835 | 44 | 14 | 1.4 | 4.2 | 4.3 | good |
| 132 | 835 | 46 | 16 | 1.5 | 4.5 | 4 | good |
| 133 | 840 | 44 | 20 | 1.4 | 5.0 | 3.8 | good |
| 134 | 835 | 45 | 18 | 1.6 | 4.6 | 3.9 | good |
| 135 | 845 | 45 | 15 | 1.5 | 4.8 | 4.3 | good |
| 136 | 850 | 46 | 15 | 1.7 | 4.8 | 4.2 | good |
| 137 | 861 | 49 | 15 | 52 | 4.9 | 3.9 | good |
| 138 | 866 | 49 | 16 | 52.1 | 5.1 | 3.7 | good |
| 139 | 845 | 49 | 17 | 52 | 5.0 | 4.3 | good |
| 140 | 867 | 51 | 16 | 57.3 | 4.8 | 4.2 | good |
| 141 | 872 | 51 | 17 | 57.4 | 5.0 | 4 | good |
| 142 | 851 | 51 | 18 | 57.3 | 4.9 | 4.6 | good |
| 143 | 728 | 56 | 13 | 31.2 | 5.0 | 3.7 | good |
| 144 | 733 | 56 | 14 | 31.3 | 5.2 | 3.5 | good |
| 145 | 703 | 56 | 15 | 31.2 | 5.1 | 4.1 | good |
| 146 | 734 | 58 | 17 | 35.4 | 4.9 | 3.8 | good |
| 147 | 739 | 58 | 18 | 35.5 | 5.1 | 3.6 | good |
| 148 | 709 | 58 | 19 | 35.4 | 5.0 | 4.2 | good |
| 149 | 941 | 44 | 14 | 63.2 | 4.6 | 4.3 | good |
| 150 | 946 | 44 | 15 | 63.3 | 4.8 | 4.1 | good |
| 151 | 916 | 44 | 16 | 63.2 | 4.7 | 4.7 | good |
| 152 | 947 | 45 | 15 | 67.1 | 4.3 | 4.4 | good |
| 153 | 952 | 45 | 16 | 67.2 | 4.5 | 4.2 | good |
| 154 | 922 | 45 | 17 | 67.1 | 4.4 | 4.8 | good |

TABLE 4-5

| No Comparative Example | YS (MPa) | EC (% IACS) | Drooping curl (mm) | Second phase particles × $10^5$/mm2 | peak height rate(1) α = 20° β = 145° | peak height rate(2) α = 75° β = 185° | bendability |
|---|---|---|---|---|---|---|---|
| 1 | 760 | 40 | 18 | 1.7 | 5.7 | 3 | good |
| 2 | 755 | 40 | 15 | 1.6 | 5.5 | 2.9 | good |
| 3 | 750 | 39 | 14 | 1.4 | 6.0 | 3 | good |
| 4 | 765 | 41 | 16 | 1.6 | 5.8 | 2.7 | good |
| 5 | 760 | 41 | 15 | 2.2 | 5.5 | 3.1 | good |
| 6 | 755 | 40 | 15 | 2.3 | 6.0 | 2.6 | good |
| 7 | 760 | 40 | 14 | 1.4 | 5.5 | 3.2 | good |
| 8 | 755 | 41 | 15 | 2.1 | 5.6 | 3.1 | good |
| 9 | 745 | 42 | 12 | 2.2 | 5.7 | 2.8 | good |
| 10 | 475 | 24 | 9 | 1.4 | 5.5 | 3.1 | good |
| 11 | 465 | 23 | 8 | 1.3 | 5.8 | 2.9 | good |
| 12 | 460 | 22 | 8 | 1.2 | 5.5 | 2.9 | good |
| 13 | 820 | 45 | 48 | 1.4 | 5.6 | 3.3 | good |
| 14 | 765 | 41 | 15 | 1.3 | 5.9 | 3.1 | good |
| 15 | 770 | 42 | 14 | 1.1 | 6.3 | 3 | good |
| 16 | 775 | 42 | 15 | 1.4 | 5.4 | 2.8 | good |
| 17 | 770 | 41 | 12 | 1.9 | 5.5 | 2.8 | good |
| 18 | 775 | 42 | 15 | 2.1 | 5.6 | 3 | good |
| 19 | 780 | 42 | 12 | 1.3 | 5.3 | 3.2 | good |
| 20 | 775 | 42 | 15 | 1.9 | 5.7 | 2.7 | good |

TABLE 4-5-continued

| No Comparative Example | YS (MPa) | EC (% IACS) | Drooping curl (mm) | Second phase particles × $10^5$/mm2 | peak height rate(1) α = 20° β = 145° | peak height rate(2) α = 75° β = 185° | bendability |
|---|---|---|---|---|---|---|---|
| 21 | 780 | 43 | 16 | 1.5 | 5.4 | 3.3 | good |
| 22 | 785 | 43 | 15 | 1 | 5.8 | 3.2 | good |
| 23 | 780 | 43 | 15 | 1 | 5.6 | 2.9 | good |
| 24 | 785 | 43 | 14 | 0.9 | 5.4 | 3.1 | good |
| 25 | 789 | 44 | 12 | 0.9 | 5.3 | 3 | good |
| 26 | 770 | 45 | 15 | 1.5 | 5.6 | 3 | good |
| 27 | 775 | 45 | 15 | 1.6 | 5.3 | 3 | good |
| 28 | 780 | 46 | 15 | 0.9 | 5.7 | 3.2 | good |
| 29 | 765 | 45 | 13 | 1.5 | 5.7 | 3.1 | good |
| 30 | 772 | 46 | 8 | 1.6 | 5.8 | 3.1 | good |
| 31 | 775 | 47 | 14 | 1.5 | 6.3 | 3.2 | good |
| 32 | 780 | 44 | 16 | 1.4 | 6.0 | 2.9 | good |
| 33 | 785 | 44 | 15 | 1.3 | 5.4 | 3 | good |
| 34 | 789 | 43 | 15 | 1.4 | 5.6 | 2.9 | good |
| 35 | 770 | 44 | 14 | 2.2 | 5.3 | 3 | good |
| 36 | 780 | 44 | 12 | 2.1 | 5.7 | 3.1 | good |
| 37 | 785 | 45 | 12 | 1.3 | 6.3 | 3.3 | good |
| 38 | 765 | 44 | 15 | 1.9 | 5.4 | 3.1 | good |
| 39 | 775 | 44 | 12 | 2 | 6.0 | 3.1 | good |
| 40 | 780 | 45 | 15 | 1.6 | 5.4 | 3.2 | good |
| 41 | 780 | 44 | 16 | 1.4 | 6.0 | 2.9 | good |
| 42 | 785 | 45 | 13 | 1.2 | 5.3 | 2.8 | good |
| 43 | 788 | 45 | 13 | 1.5 | 5.6 | 3 | good |
| 44 | 770 | 44 | 15 | 2.1 | 5.3 | 3 | good |
| 45 | 775 | 45 | 13 | 2.2 | 5.6 | 3.2 | good |
| 46 | 780 | 45 | 8 | 1.3 | 6.2 | 3.3 | good |
| 47 | 765 | 45 | 14 | 2.1 | 5.4 | 3.1 | good |
| 48 | 775 | 46 | 16 | 2 | 5.9 | 3.2 | good |
| 49 | 780 | 46 | 15 | 1.2 | 5.4 | 3.2 | good |

TABLE 4-6

| No Comparative Example | YS (MPa) | EC (% IACS) | Drooping curl (mm) | Second phase particles × $10^5$/mm2 | peak height rate(1) α = 20° β = 145° | peak height rate(2) α = 75° β = 185° | bendability |
|---|---|---|---|---|---|---|---|
| 50 | 760 | 42 | 15 | 1.1 | 6.0 | 3.3 | good |
| 51 | 765 | 43 | 14 | 1.1 | 5.3 | 3.1 | good |
| 52 | 775 | 43 | 12 | 1.3 | 5.5 | 3 | good |
| 53 | 755 | 44 | 15 | 1.8 | 5.3 | 2.8 | good |
| 54 | 760 | 45 | 13 | 1.7 | 5.6 | 2.9 | good |
| 55 | 765 | 45 | 14 | 1.1 | 6.1 | 3 | good |
| 56 | 755 | 44 | 16 | 1.7 | 5.4 | 3.2 | good |
| 57 | 760 | 45 | 15 | 1.8 | 5.9 | 2.7 | good |
| 58 | 770 | 45 | 15 | 1.9 | 5.4 | 3.3 | good |
| 59 | 770 | 41 | 13 | 1.9 | 5.6 | 3.1 | good |
| 60 | 765 | 41 | 8 | 1.8 | 5.4 | 3 | good |
| 61 | 760 | 40 | 14 | 1.6 | 5.9 | 3.1 | good |
| 62 | 775 | 42 | 16 | 1.8 | 5.7 | 2.8 | good |
| 63 | 770 | 42 | 15 | 2.4 | 5.4 | 3.2 | good |
| 64 | 765 | 41 | 15 | 2.5 | 5.9 | 2.7 | good |
| 65 | 770 | 41 | 14 | 1.6 | 5.4 | 3.3 | good |
| 66 | 765 | 40 | 12 | 2.3 | 5.5 | 3.2 | good |
| 67 | 755 | 42 | 12 | 2.4 | 5.6 | 2.9 | good |
| 68 | 485 | 25 | 15 | 1.5 | 5.4 | 3.2 | good |
| 69 | 475 | 24 | 12 | 1.4 | 5.7 | 3 | good |
| 70 | 470 | 23 | 11 | 1.3 | 5.4 | 3 | good |
| 71 | 825 | 46 | 52 | 1.5 | 5.7 | 3.3 | good |
| 72 | 775 | 42 | 16 | 2.2 | 6.0 | 2.9 | good |
| 73 | 780 | 43 | 15 | 2.1 | 5.4 | 2.8 | good |
| 74 | 785 | 43 | 15 | 1.4 | 5.6 | 3 | good |
| 75 | 780 | 42 | 14 | 2 | 5.3 | 3 | good |
| 76 | 785 | 43 | 12 | 2.1 | 5.7 | 3.2 | good |
| 77 | 790 | 43 | 15 | 1.9 | 6.3 | 3.3 | good |
| 78 | 785 | 43 | 13 | 1.8 | 5.4 | 3.1 | good |
| 79 | 790 | 44 | 14 | 1.6 | 6.0 | 3.2 | good |
| 80 | 795 | 44 | 16 | 1.9 | 5.6 | 3.2 | good |
| 81 | 790 | 44 | 15 | 2.4 | 5.3 | 3.3 | good |
| 82 | 792 | 44 | 15 | 2.6 | 5.4 | 3.1 | good |

TABLE 4-6-continued

| No Comparative Example | YS (MPa) | EC (% IACS) | Drooping curl (mm) | Second phase particles × $10^5$/mm2 | peak height rate(1) α = 20° β = 145° | peak height rate(2) α = 75° β = 185° | bendability |
|---|---|---|---|---|---|---|---|
| 83 | 797 | 45 | 16 | 1.7 | 5.7 | 3 | good |
| 84 | 780 | 46 | 15 | 2.1 | 5.5 | 2.8 | good |
| 85 | 787 | 46 | 15 | 2.5 | 5.6 | 2.9 | good |
| 86 | 792 | 47 | 14 | 2.1 | 5.8 | 2.8 | good |
| 87 | 775 | 46 | 12 | 1.9 | 5.7 | 3.2 | good |
| 88 | 782 | 47 | 15 | 1.7 | 5.4 | 2.7 | good |
| 89 | 789 | 48 | 15 | 1.9 | 5.4 | 3.2 | good |
| 90 | 790 | 45 | 15 | 2.5 | 5.3 | 3 | good |
| 91 | 795 | 45 | 13 | 2.7 | 5.6 | 2.9 | good |
| 92 | 799 | 46 | 8 | 1.8 | 5.9 | 3.1 | good |
| 93 | 780 | 45 | 14 | 2.6 | 5.5 | 3.3 | good |
| 94 | 790 | 45 | 16 | 2.4 | 5.6 | 3.1 | good |
| 95 | 795 | 46 | 15 | 1.6 | 5.4 | 3.2 | good |
| 96 | 775 | 45 | 15 | 1.3 | 5.7 | 3.2 | good |
| 97 | 785 | 45 | 14 | 1.4 | 5.3 | 3.3 | good |
| 98 | 790 | 46 | 12 | 1.7 | 5.4 | 3.2 | good |

TABLE 4-7

| No Comparative Example | YS (MPa) | EC (% IACS) | Drooping curl (mm) | Second phase particles × $10^5$/mm2 | peak height rate(1) α = 20° β = 145° | peak height rate(2) α = 75° β = 185° | bendability |
|---|---|---|---|---|---|---|---|
| 99 | 790 | 45 | 15 | 2.2 | 5.3 | 3.1 | good |
| 100 | 795 | 46 | 15 | 2.4 | 5.4 | 2.8 | good |
| 101 | 799 | 46 | 14 | 1.5 | 5.7 | 2.9 | good |
| 102 | 780 | 45 | 12 | 2.4 | 5.5 | 2.7 | good |
| 103 | 785 | 46 | 15 | 2.5 | 5.7 | 3.2 | good |
| 104 | 790 | 46 | 15 | 2.3 | 5.6 | 2.7 | good |
| 105 | 775 | 46 | 15 | 2.1 | 5.7 | 3.2 | good |
| 106 | 785 | 47 | 13 | 2 | 5.4 | 3.1 | good |
| 107 | 790 | 47 | 8 | 2.1 | 5.9 | 3.1 | good |
| 108 | 770 | 43 | 14 | 1.8 | 5.7 | 3.2 | good |
| 109 | 775 | 44 | 16 | 1.9 | 5.4 | 3.3 | good |
| 110 | 785 | 44 | 15 | 1.7 | 5.9 | 3.1 | good |
| 111 | 765 | 45 | 15 | 1.8 | 5.4 | 3.2 | good |
| 112 | 770 | 46 | 14 | 1.9 | 5.5 | 3.1 | good |
| 113 | 775 | 46 | 16 | 1.9 | 5.6 | 3.3 | good |
| 114 | 765 | 45 | 9 | 1.5 | 5.4 | 3.1 | good |
| 115 | 770 | 46 | 13 | 1.8 | 5.7 | 3 | good |
| 116 | 780 | 46 | 15 | 2 | 5.4 | 2.8 | good |
| 117 | 790 | 45 | 14 | 1.5 | 5.7 | 2.9 | good |
| 118 | 795 | 45 | 16 | 1.6 | 5.4 | 3.1 | good |
| 119 | 799 | 46 | 14 | 1.7 | 5.9 | 3.2 | good |
| 120 | 797 | 47 | 16 | 2.1 | 5.4 | 2.7 | good |
| 121 | 792 | 48 | 13 | 2.3 | 5.3 | 2.8 | good |
| 122 | 790 | 48 | 18 | 2.3 | 6.2 | 2.9 | good |
| 123 | 795 | 47 | 17 | 2.3 | 6.4 | 2.8 | good |
| 124 | 790 | 48 | 15 | 2.4 | 5.6 | 3.2 | good |
| 125 | 785 | 49 | 13 | 2.4 | 5.4 | 2.8 | good |
| 126 | 645 | 51 | 11 | 0.1 | 5.3 | 3 | good |
| 127 | 650 | 51 | 10 | 0.2 | 5.4 | 3.2 | good |
| 128 | 655 | 52 | 12 | 0.2 | 5.5 | 3.1 | good |
| 129 | 650 | 51 | 39 | 0.3 | 5.6 | 3.2 | good |
| 130 | 855 | 39 | 15 | 2.5 | 5.4 | 3.3 | good |
| 131 | 860 | 39 | 17 | 2.6 | 5.7 | 3 | good |
| 132 | 870 | 40 | 19 | 2.8 | 5.4 | 2.7 | good |
| 133 | 870 | 39 | 50 | 0.4 | 5.9 | 3.1 | good |
| 134 | 655 | 52 | 12 | 0.4 | 5.7 | 2.9 | good |
| 135 | 660 | 53 | 14 | 0.6 | 5.7 | 3 | good |
| 136 | 670 | 53 | 13 | 0.6 | 5.7 | 3.3 | good |
| 137 | 670 | 52 | 38 | 0.7 | 5.4 | 3.3 | good |
| 138 | 865 | 39 | 14 | 2.7 | 5.7 | 2.8 | good |
| 139 | 870 | 39 | 15 | 2.8 | 5.4 | 3 | good |
| 140 | 875 | 40 | 17 | 2.9 | 5.8 | 2.7 | good |
| 141 | 880 | 39 | 51 | 3 | 5.4 | 3.1 | good |
| 142 | 775 | 42 | 13 | 1.5 | 5.5 | 2.6 | good |
| 143 | 780 | 42 | 14 | 1.6 | 5.6 | 2.5 | good |
| 144 | 784 | 43 | 13 | 1.7 | 5.4 | 3 | good |

TABLE 4-7-continued

| No Comparative Example | YS (MPa) | EC (% IACS) | Drooping curl (mm) | Second phase particles × $10^5$/mm2 | peak height rate(1) α = 20° β = 145° | peak height rate(2) α = 75° β = 185° | bendability |
|---|---|---|---|---|---|---|---|
| 145 | 810 | 42 | 45 | 1.8 | 5.7 | 3 | good |
| 146 | 775 | 41 | 12 | 1.3 | 5.3 | 3.2 | good |
| 147 | 780 | 41 | 13 | 1.5 | 5.5 | 3 | good |
| 148 | 784 | 42 | 14 | 1.8 | 5.3 | 3.1 | good |
| 149 | 810 | 41 | 43 | 1.9 | 5.4 | 2.8 | good |

TABLE 4-8

| No Comparative Example | YS (MPa) | EC (% IACS) | Drooping curl (mm) | Second phase particles × $10^5$/mm2 | peak height rate(1) α = 20° β = 145° | peak height rate(2) α = 75° β = 185° | bendability |
|---|---|---|---|---|---|---|---|
| 150 | 765 | 43 | 15 | 1.7 | 5.7 | 3.2 | good |
| 151 | 770 | 43 | 18 | 1.8 | 5.3 | 2.7 | good |
| 152 | 774 | 44 | 16 | 1.9 | 5.7 | 3.3 | good |
| 153 | 800 | 43 | 40 | 2 | 6.3 | 3.2 | good |
| 154 | 790 | 42 | 12 | 1.4 | 5.4 | 2.9 | good |
| 155 | 795 | 42 | 16 | 1.5 | 6.0 | 3.2 | good |
| 156 | 799 | 43 | 14 | 1.4 | 5.4 | 3 | good |
| 157 | 825 | 42 | 48 | 1.6 | 5.6 | 3 | good |
| 158 | 765 | 43 | 13 | 1.8 | 5.3 | 3.2 | good |
| 159 | 770 | 43 | 14 | 1.7 | 5.4 | 2.9 | good |
| 160 | 774 | 44 | 14 | 1.7 | 5.5 | 2.8 | good |
| 161 | 820 | 43 | 48 | 1.7 | 5.6 | 2.9 | good |
| 162 | 765 | 42 | 12 | 1.6 | 5.4 | 3 | good |
| 163 | 770 | 42 | 16 | 1.8 | 5.7 | 2.7 | good |
| 164 | 774 | 43 | 18 | 1.9 | 6.3 | 3.3 | good |
| 165 | 820 | 42 | 45 | 1.8 | 5.4 | 3.1 | good |
| 166 | 755 | 44 | 11 | 1.8 | 6.0 | 3.2 | good |
| 167 | 760 | 44 | 12 | 1.9 | 5.5 | 3.3 | good |
| 168 | 764 | 45 | 13 | 2 | 5.6 | 3.2 | good |
| 169 | 810 | 44 | 45 | 1.9 | 5.5 | 2.9 | good |
| 170 | 780 | 43 | 12 | 1.6 | 5.4 | 3.1 | good |
| 171 | 785 | 43 | 11 | 1.8 | 5.5 | 3 | good |
| 172 | 789 | 44 | 14 | 1.8 | 5.5 | 3 | good |
| 173 | 835 | 43 | 50 | 1.7 | 5.6 | 3 | good |
| 174 | 831 | 47 | 13 | 51.3 | 5.3 | 3 | good |
| 175 | 840 | 48 | 13 | 54.5 | 5.4 | 3 | good |
| 176 | 854 | 49 | 45 | 58.2 | 5.7 | 2.9 | good |
| 177 | 860 | 51 | 50 | 61.5 | 5.8 | 3 | good |
| 178 | 687 | 53 | 16 | 27.5 | 5.3 | 2.8 | good |
| 179 | 698 | 55 | 17 | 29.2 | 5.3 | 2.9 | good |
| 180 | 710 | 55 | 42 | 31.2 | 5.6 | 2.8 | good |
| 181 | 718 | 57 | 43 | 32.9 | 5.7 | 2.9 | good |
| 182 | 900 | 41 | 14 | 55.0 | 5.4 | 3 | good |
| 183 | 905 | 42 | 13 | 58.4 | 5.5 | 3.1 | good |
| 184 | 923 | 43 | 49 | 62.4 | 5.8 | 3 | good |
| 185 | 925 | 44 | 50 | 65.9 | 5.9 | 3.1 | good |
| 186 | 770 | 48 | 8 | 1.5 | 5.6 | 2.8 | good |
| 187 | 780 | 49 | 10 | 2.1 | 5.4 | 3.2 | good |
| 188 | 775 | 45 | 14 | 1.6 | 6.0 | 3.1 | good |
| 189 | 785 | 46 | 13 | 2 | 5.9 | 3 | good |
| 190 | 870 | 44 | 14 | 1.4 | 6.0 | 3 | bad |
| 191 | 880 | 45 | 16 | 1.7 | 5.8 | 2.8 | bad |

Consideration

Examples No. 1 to 154 have "peak height ratio of β angle 145° at α=20°" of 5.2 times or smaller and "peak height ratio of β angle 185° at α=75°" of 3.4 times or greater, and it is understood that these Examples are excellent in the balance between strength and electrical conductivity. In addition, it is understood that the drooping curl can be prevented in these Examples and these Examples are excellent in bendability. In Examples No. 137 to 154, among second phase particles precipitated in the matrix phase of the alloy, the number density of those particles having a particle size of 0.1 μm to 1 μm is $5\times10^5$ to $1\times10^7$/mm$^2$, and these Examples achieved more excellent characteristics.

Comparative Examples No. 7 to 12, No. 65 to 70, No. 174, No. 175, No. 178, No. 179, No. 182 and No. 183 are examples of conducting the first aging by single-stage aging.

Comparative Examples No. 1 to 6, No. 13, No. 59 to 64, No. 71, No. 129, No. 133, No. 137, No. 141, No. 145, No. 149, No. 153, No. 157, No. 161, No. 165, No. 169, No. 173, No. 176, No. 177, No. 180, No. 181, No. 184 and No. 185 are examples of conducting the first aging by two-stage aging.

Comparative Examples No. 14 to 58, No. 72 to 116, No. 126 to 128, No. 130 to 132, No. 134 to 136, No. 138 to 140, No. 142 to 144, No. 146 to 148, No. 150 to 152, No. 154 to 156, No. 158 to 160, No. 162 to 164 and No. 166 to 168 170-172 are examples with short aging times of the third stage.

Comparative Examples No. 117 to 119 are examples with low aging temperatures of the third stage.

Comparative Examples No. 120 to 122 are examples with high aging temperatures of the third stage.

Comparative Examples No. 123 to 125 are examples with long aging times of the third stage.

Comparative Examples No. 186 and 187 are examples in which the cooling rates from the first stage to the second stage and from the second stage to the third stage are too high.

Comparative Examples No. 188 and 189 are examples in which the cooling rates from the first stage to the second stage and from the second stage to the third stage are too low.

Comparative Examples No. 190 and 191 are examples produced by undergoing similar processes as Examples until cold rolling after the first aging, and conducting the second aging and cold rolling thereafter.

Comparative Examples No. 13, No. 71, No. 129, No. 133, No. 137, No. 141, No. 145, No. 149, No. 153, No. 157, No. 161, No. 165, No. 169, No. 173, No. 176, No. 177, No. 180, No. 181, No. 184, No. 185, No. 190 and No. 191 are examples of also conducting the second aging.

All of Comparative Examples have "peak height ratio of β angle 145° at α=20°" of greater than 5.2 times and "peak height ratio of β angle 185° at α=75°" of less than 3.4 times, and it is understood that the Comparative Examples are poorer in the balance between strength, electrical conductivity and drooping curl as compared with Examples.

Figure 2:
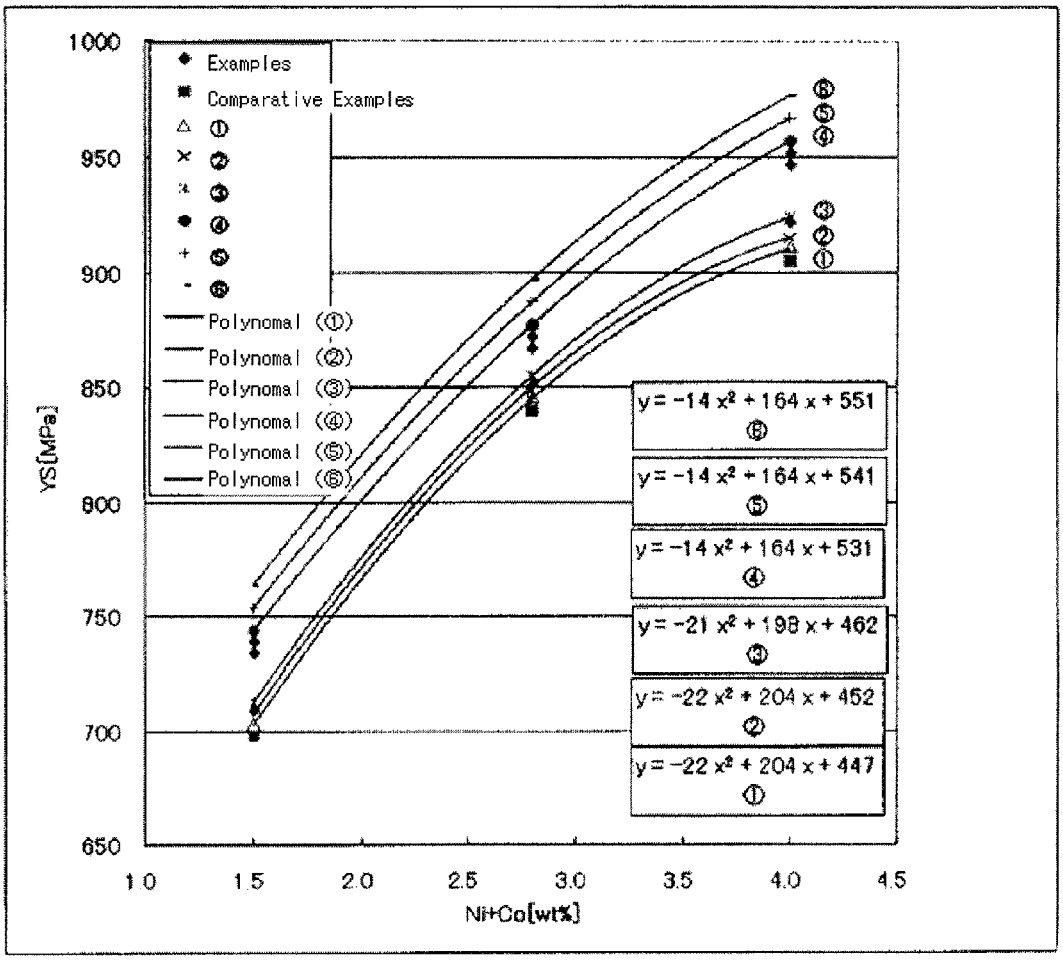
FIG. 2 is a figure regarding Example No. 140-142, No. 146-148, No. 152-154 and Comparative Example No. 175, 179, 183, with total percentage concentration by mass of Ni and Co on the x-axis and YS on the y-axis.
Figure 3:
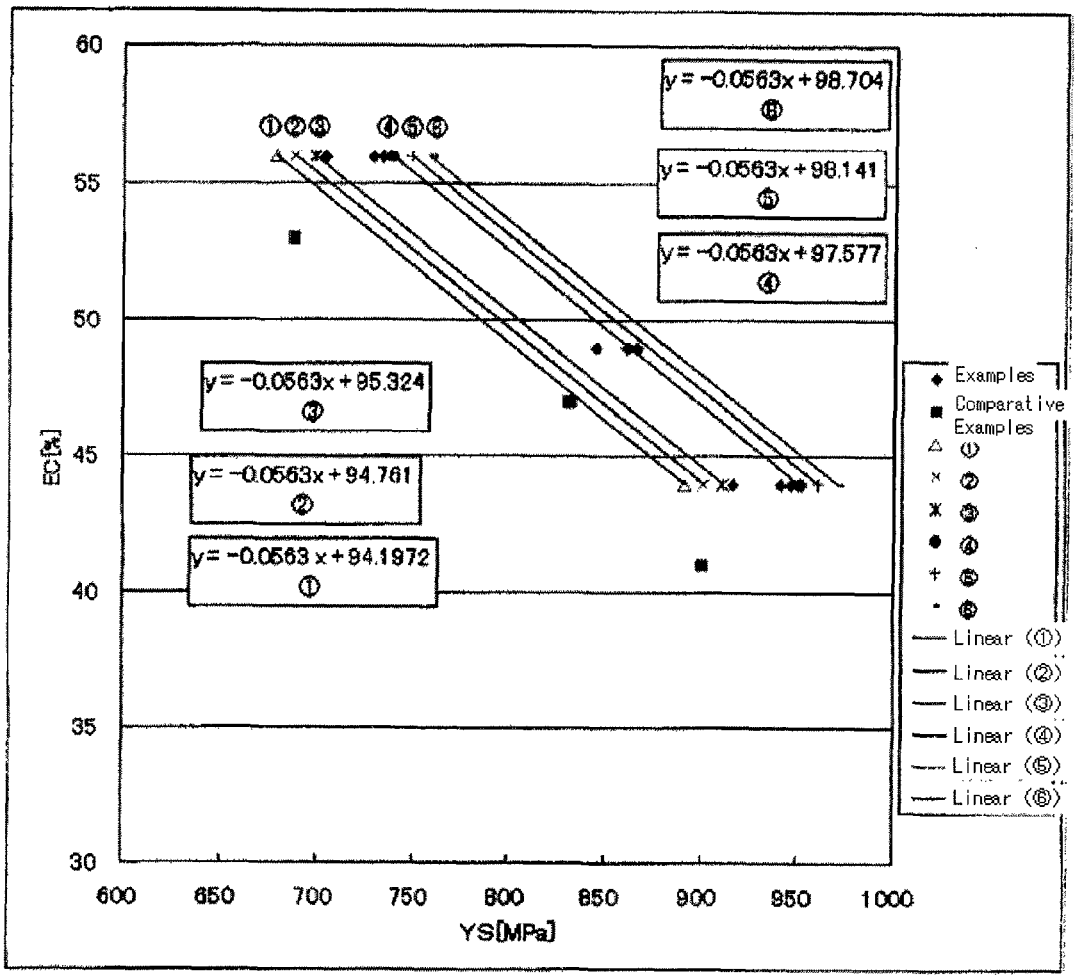
FIG. 3 is a figure regarding Example No. 137-139, No. 143-145, No. 149-151 and Comparative Example No. 174, 178, 182, with YS on the x-axis and EC on the y-axis.
Figure 4:
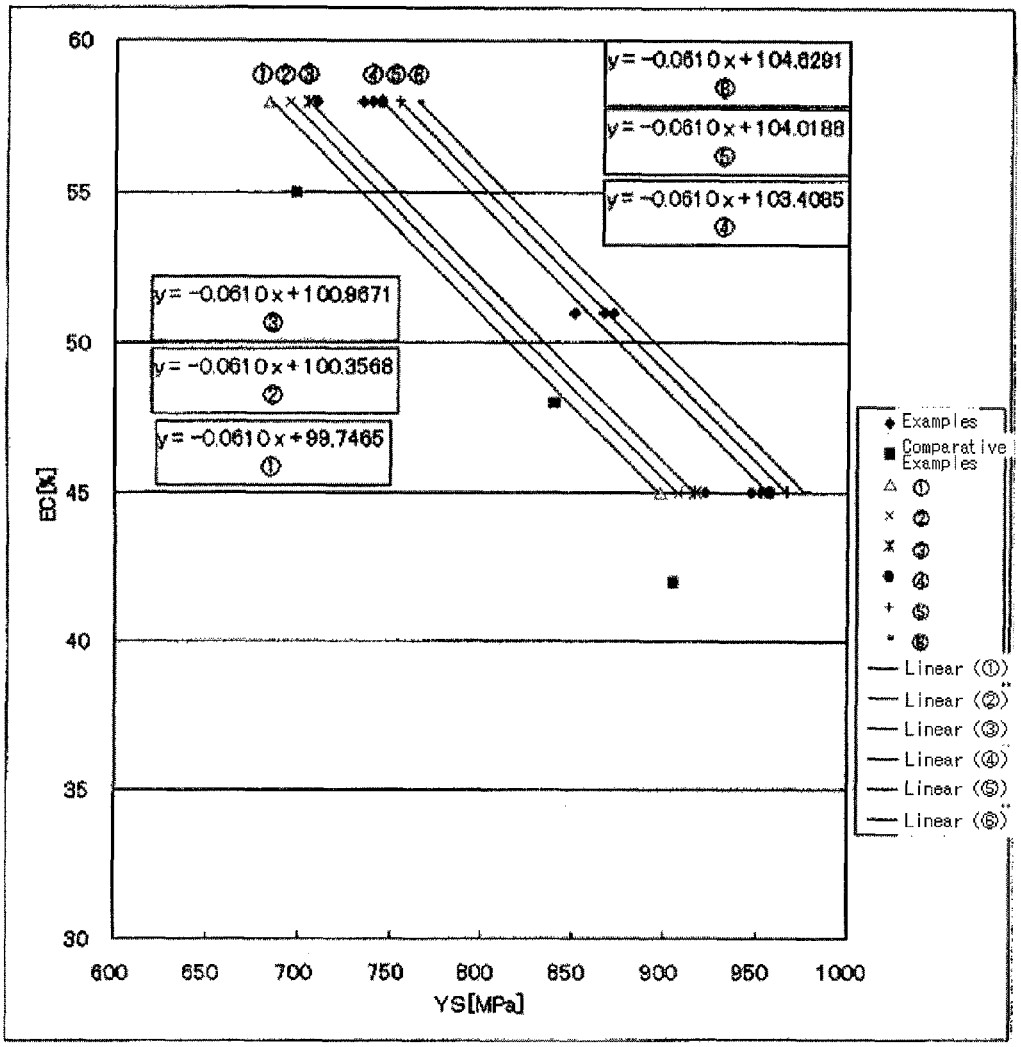
FIG. 4 is a figure regarding Example No. 140-142, No. 146-148, No. 152-154 and Comparative Example No. 175, 179, 183, with YS on the x-axis and EC on the y-axis.

Furthermore, in relation to Examples No. 137 to 154 and Comparative Examples No. 174 to 185 in which the cooling conditions after the solution treatment were changed to preferred conditions, diagrams plotting total concentration in mass percentage (%) of Ni and Co, (Ni+Co), on the x-axis and YS on the y-axis are presented in FIG. 1 (Cr not added) and FIG. 2 (Cr added), and diagrams plotting total concentration in mass percentage (%) of Ni and Co, (Ni+Co), on the x-axis and EC on the y-axis are presented in FIG. 3 (Cr not added) and FIG. 4 (Cr added).

From FIG. 1, it is understood that Examples not containing Cr satisfy the relationship expressed by the following formula: $-11\times([Ni]+[Co])^2+146\times([Ni]+[Co])+564\geq YS\geq -21\times([Ni]+[Co])^2+202\times([Ni]+[Co])+436$, Formula (i).

From FIG. 2, it is understood that Examples containing Cr satisfy the relationship expressed by the following formula: $-14\times([Ni]+[Co])^2+164\times([Ni]+[Co])+551\geq YS\geq -22\times([Ni]+[Co])^2+204\times([Ni]+[Co])+447$, Formula (ii).

From FIG. 3, it is understood that Examples not containing Cr satisfy the relationship expressed by the following formula: $-0.0563\times[YS]+94.1972\leq EC\leq -0.0563\times[YS]+98.7040$, Formula (iii).

From FIG. 4, it is understood that Examples containing Cr satisfy the relationship expressed by the following formula: $-0.0610\times[YS]+99.7465\leq EC\leq -0.0610\times[YS]+104.6291$, Formula (iv).

The invention claimed is:

1. A copper alloy strip for an electronic materials containing 1.0-2.5% by mass of Ni, 0.5-2.5% by mass of Co, 0.3-1.2% by mass of Si, and the remainder comprising Cu and unavoidable impurities, wherein the copper alloy strip satisfies both of the following (a) and (b) as determined by means of X-ray diffraction pole figure measurement based on a rolled surface:

(a) among diffraction peak intensities obtained by β scanning at α=20° in a {200} pole figure, a peak height at β angle 145° is not more than 5.2 times that of standard copper powder; and (b) among diffraction peak intensities obtained by β scanning at α=75° in a {111} pole figure, a peak height at β angle 185° is not less than 3.4 times that of standard copper powder;

wherein a measurement of drooping curl of the copper alloy strip in a direction parallel to a rolling direction is not more than 35 mm.

2. The copper alloy strip according to claim 1, wherein Ni content [Ni] (% by mass), Co content [Co] (% by mass) and 0.2% yield strength YS (MPa) satisfy a relationship expressed by the following formula (i): $-11\times([Ni]+[Co])^2+146\times([Ni]+[Co])+564\geq YS\geq -21\times([Ni]+[Co])^2+202\times([Ni]+[Co])+436$.

3. The copper alloy strip according claim 1, wherein 0.2% yield strength YS (MPa) satisfies a relationship of $673\leq YS\leq 976$, electrical conductivity EC (% IACS) satisfies a relationship of $42.5\leq EC\leq 57.5$, and the 0.2% yield strength YS (MPa) and the electrical conductivity EC (% IACS) satisfy a relationship expressed by the following formula (iii): $-0.0563\times[YS]+94.1972\leq EC\leq -0.0563\times[YS]+98.7040$.

4. The copper alloy strip according to claim 1, wherein among second phase particles precipitated in a matrix phase, the number density of those particles having a particle size of 0.1 μm to 1 μm is $5\times10^5$ to $1\times10^7/mm^2$.

5. The copper alloy strip according to claim 1, further containing 0.03-0.5% by mass of Cr.

6. The copper alloy strip according to claim 5, wherein Ni content [Ni] (% by mass), Co content [Co] (% by mass) and 0.2% yield strength YS (MPa) satisfy a relationship expressed by the following formula (ii): $-14\times([Ni]+[Co])^2+164\times([Ni]+[Co])+551\geq YS\geq -22\times([Ni]+[Co])^2+204\times([Ni]+[Co])+447$.

7. The copper alloy strip according to claim 5, wherein 0.2% yield strength YS (MPa) satisfies a relationship of $679\leq YS\leq 982$ and electrical conductivity EC (% IACS) satisfies a relationship of $43.5\leq EC\leq 59.5$, and the 0.2% yield strength YS (MPa) and the electrical conductivity EC (% IACS) satisfy a relationship expressed by the following formula (iv): $-0.0610\times[YS]+99.7465\leq EC\leq -0.0610\times[YS]+104.6291$.

8. The copper alloy strip according to claim 1, further containing a total of up to 2.0% by mass of one or more selected from the group consisting of Mg, P, As, Sb, Be, B, Mn, Sn, Ti, Zr, Al, Fe, Zn and Ag.

9. A method for manufacturing the copper alloy strip according to claim 1, the method comprising the following steps in order:

step 1 of melting and casting an ingot having a composition selected from any one of the following (1) to (3), (1) a composition containing 1.0-2.5% by mass of Ni, 0.5-2.5% by mass of Co, 0.3-1.2% by mass of Si, and the remainder comprising Cu and unavoidable impurities, (2) a composition containing 1.0-2.5% by mass of Ni, 0.5-2.5% by mass of Co, 0.3-1.2% by mass of Si, 0.03-0.5% by mass of Cr and the remainder comprising Cu and unavoidable impurities, (3) a composition of preceding (1) or (2) further containing a total of up to 2.0% by mass of one or more selected from the group consisting of Mg, P, As, Sb, Be, B, Mn, Sn, Ti, Zr, Al, Fe, Zn and Ag;

step 2 of heating at 950-1050° C. for 1 hour or more, and then performing hot rolling, a temperature at the end of hot rolling being set at 850° C. or more, and then cooling material, an average cooling rate from 850° C. to 400° C. being 15° C./sec or more;

step 3 of performing cold rolling;

step 4 of conducting a solution treatment at 850-1050° C., and then cooling, an average cooling rate to 400° C. being 10° C./sec or more;

step 5 of conducting multiple-stage aging treatment in a batch-type furnace with material being coiled by heating at a material temperature of 400-500° C. for 1 to 12 hours in first stage, and then heating at a material temperature of 350-450° C. for 1 to 12 hours in second stage, and then heating at a material temperature of 260-340° C. for 4 to 30 hours in third stage, wherein cooling rate from the first stage to the second stage and from the second stage to the third stage is 1-8° C./min, temperature difference between the first stage and the second stage is 20-60° C., and temperature difference between the second stage and the third stage is 20-180° C.; and step 6 of performing cold rolling.

10. The method according to claim 9, further comprising a step of temper annealing by heating at a material temperature of 200-500° C. for 1 second to 1000 seconds after step 6.

11. The method according to claim 9, wherein the solution treatment in step 4 is conducted on condition that an average cooling rate to 650° C. is not less than 1° C./sec but less than 15° C./sec and an average cooling rate from 650° C. to 400° C. is not less than 15° C./sec, instead of condition that the average cooling rate to 400° C. is 10° C./sec or more.

* * * * *